US007793882B2

(12) United States Patent
Reinsel et al.

(10) Patent No.: US 7,793,882 B2
(45) Date of Patent: Sep. 14, 2010

(54) ELECTRONIC DISPENSER FOR DISPENSING SHEET PRODUCTS

(75) Inventors: Christopher M. Reinsel, Neenah, WI (US); Daniel J. Geddes, Appleton, WI (US); William J. Kane, Sutton, MA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 12/632,534

(22) Filed: Dec. 7, 2009

(65) Prior Publication Data

US 2010/0078459 A1 Apr. 1, 2010

Related U.S. Application Data

(63) Continuation of application No. 11/676,025, filed on Feb. 16, 2007.

(60) Provisional application No. 60/774,390, filed on Feb. 18, 2006, provisional application No. 60/802,612, filed on May 22, 2006.

(51) Int. Cl.
*B65H 26/00* (2006.01)

(52) U.S. Cl. ..... 242/563; 242/563.2; 242/565

(58) Field of Classification Search ..... 242/563, 242/563.2, 564.4, 564.1, 565
See application file for complete search history.

(56) References Cited

U.S. PATENT DOCUMENTS

| | | | |
|---|---|---|---|
| 2,193,759 | A | 3/1940 | Birr |
| 2,839,345 | A | 6/1958 | Engel et al. |
| 2,859,814 | A | 11/1958 | Berney |
| 2,930,663 | A | 3/1960 | Weiss |
| 3,007,650 | A | 11/1961 | Burton |
| 3,269,592 | A | 8/1966 | Slye et al. |

(Continued)

FOREIGN PATENT DOCUMENTS

| | | | |
|---|---|---|---|
| DE | 3342921 | A1 | 6/1985 |

(Continued)

OTHER PUBLICATIONS

PCT Search Report and Written Opinion for International Application No. PCT/US2007/062343; International Filing Date: Feb. 16, 2007; Date of Mailing: Sep. 26, 2007; 16 pgs.

(Continued)

*Primary Examiner*—Evan H Langdon
(74) *Attorney, Agent, or Firm*—Joel T. Charlton

(57) ABSTRACT

A dispenser for dispensing sheet product includes a housing, a proximity sensor operative to detect a presence of a user's hand at a predetermined location near the dispenser, and a dispensing mechanism disposed within the housing, the dispensing mechanism including an electronic controller operably coupled to a drive motor that is operably coupled to a feed roller to dispense the sheet product. The dispensing mechanism is operative in a first mode to be responsive to a signal from the proximity sensor to dispense the sheet product, and is operative in a second mode to dispense a next sheet product in response to an existing sheet product being torn from the dispenser. The controller is responsive to a switch adapted and configured to set an adjustable time delay between sheet feeds when the dispensing mechanism is operating in at least one of the first mode and the second mode.

2 Claims, 20 Drawing Sheets

U.S. PATENT DOCUMENTS 3,288,387 A 11/1966 Craven, Jr.
3,384,280 A 5/1968 Summersby
3,573,783 A 4/1971 Fudaley
3,628,743 A 12/1971 Bastian et al.
3,635,417 A 1/1972 Kajiwara et al.
3,636,408 A 1/1972 Shuman
3,730,409 A 5/1973 Ratti
3,743,865 A 7/1973 Riechmann
3,836,828 A 9/1974 Siegel
3,850,356 A 11/1974 Abe et al.
3,858,951 A 1/1975 Rasmussen
3,917,191 A 11/1975 Graham, Jr. et al.
4,099,118 A 7/1978 Franklin et al.
4,106,684 A 8/1978 Hartbauer et al.
4,148,442 A 4/1979 Baumann et al.
4,159,807 A 7/1979 Honsel et al.
4,165,138 A 8/1979 Hedge et al.
4,267,752 A 5/1981 Byrt et al.
4,358,169 A 11/1982 Filipowicz et al.
4,378,912 A 4/1983 Perrin et al.
4,464,622 A 8/1984 Franklin
4,475,163 A 10/1984 Chandler et al.
4,552,315 A 11/1985 Granger
4,569,467 A 2/1986 Kaminstein
4,605,988 A 8/1986 Nienhuis et al.
4,611,768 A 9/1986 Voss et al.
4,666,099 A 5/1987 Hoffman et al.
4,676,131 A 6/1987 Cassia
4,712,461 A 12/1987 Rasmussen
4,721,265 A 1/1988 Hawkins
4,738,176 A 4/1988 Cassia
4,741,340 A 5/1988 Batina et al.
4,756,485 A 7/1988 Bastian et al.
4,760,492 A 7/1988 Walsh
4,786,005 A 11/1988 Hoffman et al.
4,790,490 A 12/1988 Chakravorty
4,796,825 A 1/1989 Hawkins
4,807,823 A 2/1989 Wyant
4,807,824 A 2/1989 Gains et al.
4,823,663 A 4/1989 Hamlin
4,826,262 A 5/1989 Hartman et al.
4,831,488 A 5/1989 Playe
4,846,412 A 7/1989 Morand
4,960,248 A 10/1990 Bauer et al.
4,992,907 A 2/1991 Shreeve et al.
5,031,258 A 7/1991 Shaw
5,148,126 A 9/1992 Spencer
5,205,454 A 4/1993 Schutz et al.
5,217,035 A 6/1993 Van Marcke
5,235,882 A 8/1993 Rabourn
5,244,161 A 9/1993 Wirtz-Odenthal
5,257,711 A 11/1993 Wirtz-Odenthal
5,271,574 A 12/1993 Formon et al.
5,294,192 A 3/1994 Omdoll et al.
5,299,407 A 4/1994 Schuttler et al.
5,302,167 A 4/1994 Kley et al.
5,335,811 A 8/1994 Morand
5,365,783 A 11/1994 Zweifel
5,400,982 A 3/1995 Collins
5,452,832 A 9/1995 Niada
5,505,129 A 4/1996 Greb et al.
5,511,743 A 4/1996 Kozlowsky et al.
5,526,973 A 6/1996 Boone et al.
5,538,587 A 7/1996 Sakano et al.
5,553,522 A 9/1996 Boldrini et al.
5,558,302 A 9/1996 Jesperson
5,604,992 A 2/1997 Robinson
5,625,327 A 4/1997 Carroll et al.
5,630,526 A 5/1997 Moody
5,670,886 A 9/1997 Wolff et al.
5,682,032 A 10/1997 Philipp
5,694,653 A 12/1997 Harald
5,704,566 A 1/1998 Schutz et al.
5,730,165 A 3/1998 Philipp
5,772,291 A 6/1998 Byrd et al.
5,806,203 A 9/1998 Robinson
5,823,083 A 10/1998 Obertegger et al.
5,833,413 A 11/1998 Cornelius
5,846,003 A 12/1998 Mori et al.
5,860,344 A 1/1999 Yamamoto et al.
5,868,343 A 2/1999 Granger
5,899,406 A 5/1999 Payne
5,915,645 A 6/1999 Granger
5,950,898 A 9/1999 Menna
5,974,764 A 11/1999 Anstey et al.
5,979,822 A 11/1999 Morand et al.
5,986,549 A 11/1999 Teodorescu
6,032,898 A 3/2000 LaCount et al.
6,067,673 A 5/2000 Paese et al.
6,069,354 A 5/2000 Alfano et al.
6,105,898 A 8/2000 Byrd et al.
6,118,469 A 9/2000 Hosomi
6,145,779 A 11/2000 Johnson et al.
6,152,397 A 11/2000 Purcell
6,198,271 B1 3/2001 Heger et al.
6,279,777 B1 8/2001 Goodin et al.
6,293,486 B1 9/2001 Byrd et al.
6,297,627 B1 10/2001 Towne et al.
6,354,533 B1 3/2002 Jespersen
6,360,181 B1 3/2002 Gemmell et al.
6,363,824 B1 4/2002 Granger
6,412,655 B1 7/2002 Stuetzel et al.
6,412,679 B2 7/2002 Formon et al.
6,419,136 B2 7/2002 Formon et al.
6,486,680 B1 11/2002 Mull
6,592,067 B2 7/2003 Denen et al.
6,679,409 B2 1/2004 Petterson et al.
6,695,246 B1 2/2004 Elliott et al.
6,710,606 B2 3/2004 Morris
6,745,927 B2 * 6/2004 Formon et al. ..... 225/1
6,793,170 B2 9/2004 Denen et al.
6,830,210 B2 12/2004 Formon et al.
6,838,887 B2 1/2005 Denen et al.
6,871,815 B2 3/2005 Moody et al.
7,017,856 B2 3/2006 Moody et al.
7,044,421 B1 5/2006 Omdoll et al.
7,114,677 B2 10/2006 Formon et al.
7,185,843 B1 3/2007 Li
7,370,825 B2 5/2008 Briante et al.
7,387,274 B2 6/2008 Moody et al.
7,416,152 B2 * 8/2008 Wieser et al. ..... 242/598.5
7,644,855 B2 1/2010 Mori et al.
2002/0030061 A1 3/2002 Formon
2002/0109034 A1 8/2002 Moody et al.
2002/0109035 A1 8/2002 Denen et al.
2002/0109036 A1 8/2002 Denen et al.
2003/0110911 A1 * 6/2003 Kapiloff ..... 83/208
2003/0116003 A1 6/2003 Kipiloff
2003/0168550 A1 * 9/2003 Formon et al. ..... 242/564.1
2003/0197086 A1 10/2003 Denen et al.
2004/0135027 A1 7/2004 Elliott et al.
2004/0160234 A1 8/2004 Denen et al.
2004/0178297 A1 9/2004 Moody et al.
2004/0251375 A1 * 12/2004 Denen et al. ..... 242/563
2005/0072874 A1 4/2005 Denen et al.
2005/0109789 A1 * 5/2005 Nagayoshi ..... 221/32
2005/0127232 A1 6/2005 Moody et al.
2005/0171634 A1 8/2005 York et al.
2006/0102769 A1 5/2006 Wieser et al.
2006/0169827 A1 * 8/2006 Lewis et al. ..... 242/563
2006/0173576 A1 * 8/2006 Goerg et al. ..... 700/236
2008/0011772 A1 * 1/2008 Morris et al. ..... 221/258
2008/0078777 A1 * 4/2008 Cittadino et al. ..... 221/1
2008/0087758 A1 * 4/2008 Formon et al. ..... 242/563

| | | | | |
|---|---|---|---|---|
| 2008/0100185 | A1* | 5/2008 | Lewis | 312/34.22 |
| 2008/0128446 | A1* | 6/2008 | Kuehneman et al. | 221/10 |
| 2008/0290211 | A1 | 11/2008 | Briante et al. | |
| 2010/0044407 | A1* | 2/2010 | Yardley | 225/14 |

FOREIGN PATENT DOCUMENTS

| | | | |
|---|---|---|---|
| DE | 20108336 | U1 | 8/2001 |
| EP | 0459050 | B1 | 8/1993 |
| EP | 0994667 | B1 | 4/2000 |
| FR | 2539293 | A1 | 7/1984 |
| FR | 2583729 | A1 | 12/1986 |
| FR | 2771620 | A1 | 6/1999 |
| GB | 2058014 | A | 4/1981 |
| GB | 2267271 | A | 12/1993 |
| JP | 63295344 | A1 | 1/1988 |
| WO | 9933008 | A2 | 7/1999 |

OTHER PUBLICATIONS

Opposition filed by ILLE Paper-Service GmbH on Apr. 30, 2007, against European Patent No. 1231823, Application No. 02250924.4.
English Translation of the Opposition filed by ILLE Paper-Service GmbH on Apr. 30, 2007, against European Patent No. 1231823, Application No. 02250924.4.
Extended European Search Report that Issued Jul. 17, 2008, in Connection with European Patent Application No. 06118266.3.
Office Action for U.S. Appl. No. 12/131,368 mailed Aug. 19, 2009.
Office Action for U.S. Appl. No. 12/131,368 mailed Dec. 10, 2009.
Office Action for U.S. Appl. No. 11/676,025 mailed Apr. 14, 2009.
Office Action for U.S. Appl. No. 11/676,025 mailed Nov. 2, 2009.
Final Office Action for U.S. Appl. No. 11/676,025 mailed Jan. 26, 2010.
Office Action for U.S. Appl. No. 11/676,025 mailed Feb. 25, 2010.
Office Action for U.S. Appl. No. 12/131,368 mailed May 11, 2010.

* cited by examiner

ELECTRONIC DISPENSER FOR DISPENSING SHEET PRODUCTS

CROSS-REFERENCE TO RELATED APPLICATIONS

This continuation application claims the benefit of the filing date of U.S. patent application Ser. No. 11/676,025, filed Feb. 16, 2007 and presently pending, which claims the benefit of the filing dates of U.S. Provisional Patent Application No. 60/774,390, filed Feb. 18, 2006 and U.S. Provisional Patent Application No. 60/802,612, filed May 22, 2006, all of which are herein incorporated by reference in their entirety.

BACKGROUND

The present disclosure generally relates to sheet product dispensers such as paper towel dispensers, and more particularly, to electronic dispensers for touch-less dispensing of sheet products.

Sheet product dispensers, such as paper towel dispensers, are often provided in public washrooms, adjacent to sinks and in other areas where a convenient and disposable drying medium is desired. Sheet product dispensers that allow "hands-free" or "touch-less" dispensing have recently grown in popularity in public washrooms, as a result of an increased awareness by the public to hygiene. For example, hands-free paper towel dispensers permit paper towels to be dispensed as may be needed without a user having to touch a mechanical surface, which may have been contaminated by people who previously used the mechanical towel dispenser without washing their hands or without having washed their hands well.

Touch-less dispensing also permits ease in dispensing for those individuals with arthritis or other afflictions that would make mechanical dispensing difficult. Additionally, touch-less dispensing permits ease in dispensing for those individuals with paint, grease or other substances on their hands. These individuals with substances on their hands would need to touch a mechanical surface, which would then have to be cleaned.

While touch-less dispensers have been successful in dispensing paper towels, a continual need exists for improvements to electronic touch-less dispensers.

BRIEF SUMMARY

Disclosed herein is an improved electronic touch-less sheet product dispenser.

In one embodiment, an electronic dispenser for dispensing sheet products includes an infrared proximity sensor operative to detect a presence of a user's hand at a predetermined location near the dispenser and a feed mechanism configured to engage a sheet product roll to cause a quantity of sheet product to be dispensed therethrough. The infrared proximity sensor is configured to have an adjustable sensitivity to vary a detection range of the infrared proximity sensor. The feed mechanism has a motor operative in response to the infrared proximity sensor to engage the feed mechanism.

In one embodiment, an electronic dispenser for dispensing sheet products includes a housing adapted to engage a wall in a recessed manner; an infrared proximity sensor operative to detect a presence of a user's hand at a predetermined location near the dispenser; and a feed mechanism disposed within the housing, configured to engage a sheet product roll to cause a quantity of sheet product to be dispensed therethrough. The feed mechanism has a motor operative in response to the infrared proximity sensor to engage the feed mechanism.

In one embodiment, an electronic dispenser for dispensing sheet products includes a housing adapted to engage a wall in a recessed manner, an infrared proximity sensor operative to detect a presence of a user's hand at a predetermined location near the dispenser, a feed mechanism configured to engage a sheet product roll to cause a quantity of sheet product to be dispensed therethrough, and a movable paper level arm which engages the sheet product roll and moves in response to a change of diameter of the sheet product roll. The infrared proximity sensor is configured to have an adjustable sensitivity to vary a detection range of the infrared proximity sensor. The feed mechanism has a motor operative in response to the infrared proximity sensor to engage the feed mechanism or operative in response to the sheet product being torn from the dispenser.

In one embodiment, a dispenser for dispensing sheet product includes a housing, a proximity sensor operative to detect a presence of a user's hand at a predetermined location near the dispenser, and a dispensing mechanism disposed within the housing, the dispensing mechanism including an electronic controller operably coupled to a drive motor that is operably coupled to a feed roller to dispense the sheet product. The dispensing mechanism is operative in a first mode to be responsive to a signal from the proximity sensor to dispense the sheet product, and is operative in a second mode to dispense a next sheet product in response to an existing sheet product being torn from the dispenser. The controller is responsive to a switch adapted and configured to set an adjustable time delay between sheet feeds when the dispensing mechanism is operating in at least one of the first mode and the second mode.

In one embodiment, a dispenser for dispensing sheet product includes a housing, a proximity sensor operative to detect a presence of a user's hand at a predetermined location near the dispenser, and a dispensing mechanism disposed within the housing, the dispensing mechanism including an electronic controller operably coupled to a drive motor that is operably coupled to a feed roller to dispense the sheet product. The dispensing mechanism is operative in a hang mode to dispense a next sheet product in response to an existing sheet product being torn from the dispenser, and the controller is responsive to a switch adapted and configured to set an adjustable time delay between sheet feeds.

The above described and other features are exemplified by the following Figures and detailed description.

BRIEF DESCRIPTION OF THE DRAWINGS

Referring to the exemplary drawings wherein like elements are numbered alike in the several Figures.

DETAILED DESCRIPTION

Figure 1:
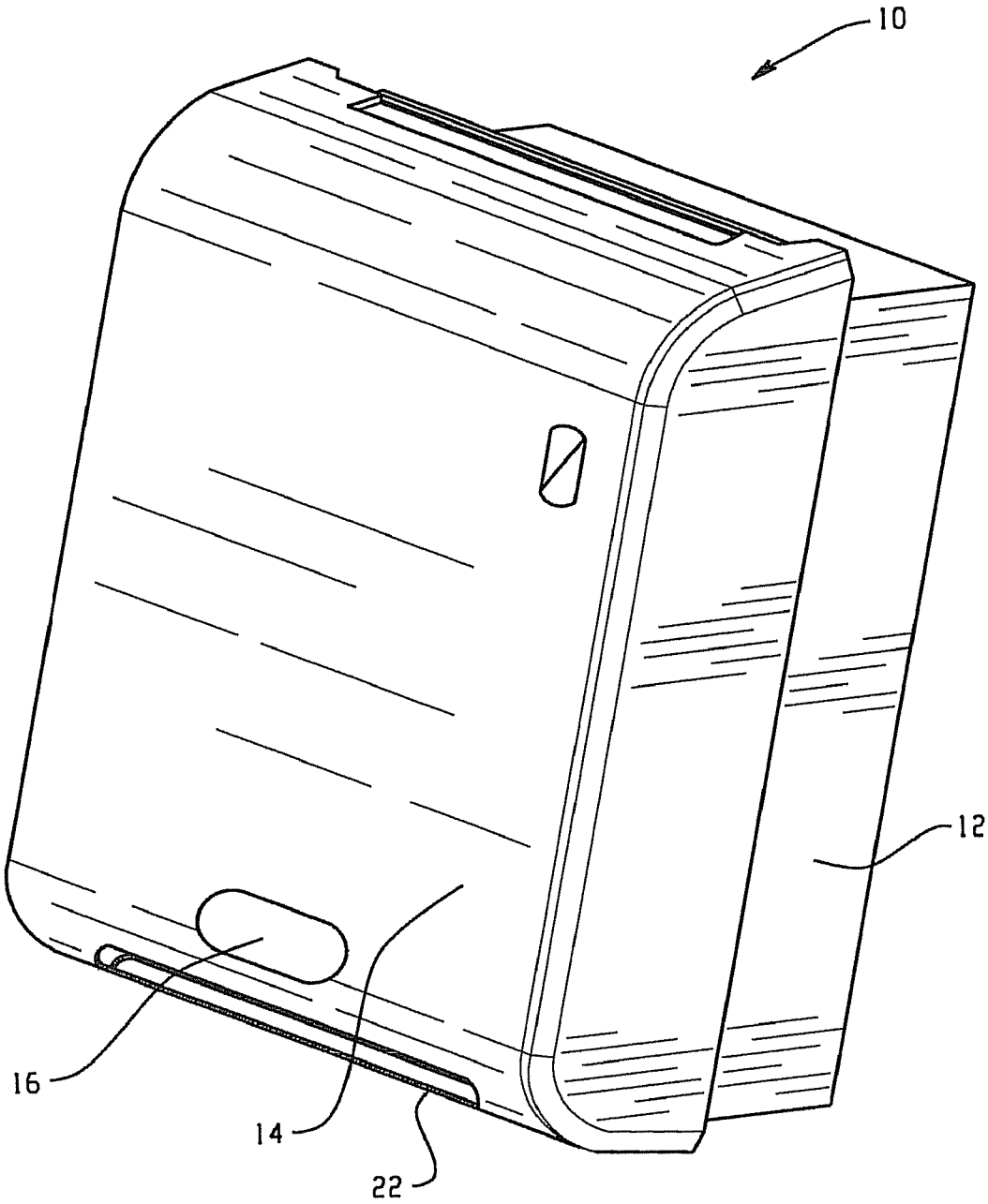
FIG. 1 is an isometric view of a dispenser embodiment with a cover closed, with no internal mechanisms visible.
Figure 2:
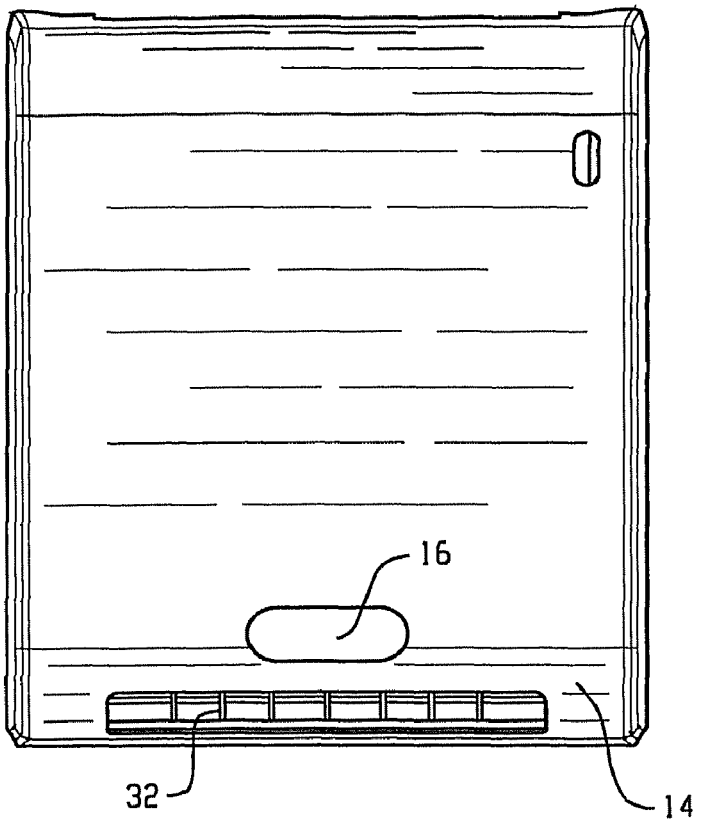
FIG. 2 is a front view of the dispenser with the cover closed.
Figure 3:
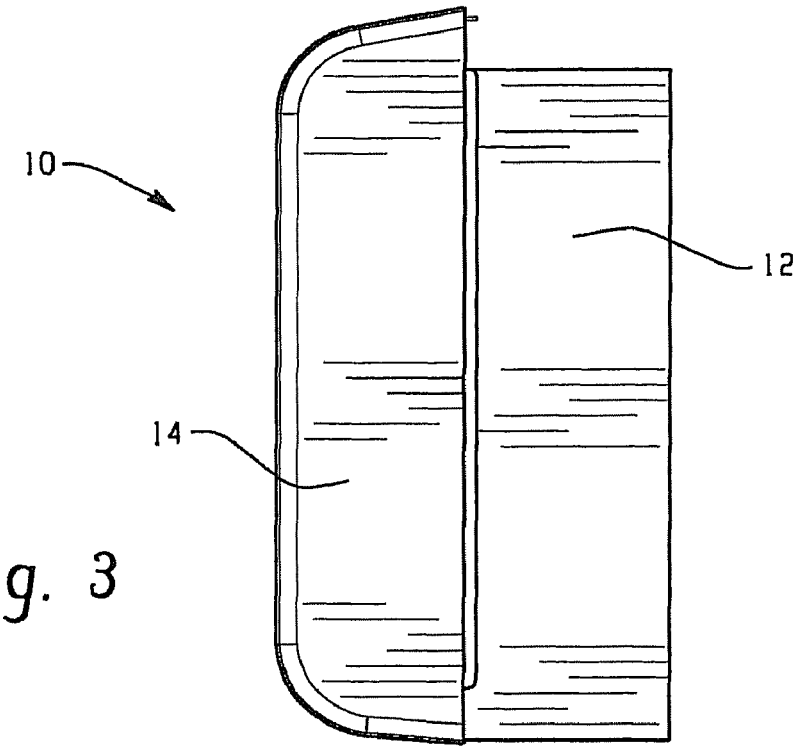
FIG. 3 is a right side view of the dispenser with the cover closed.

Disclosed herein is an improved electronic touch-less sheet product dispenser. As will be discussed in greater detail below, embodiments of the touch-less electronic dispenser include a number of improvements over existing touch-less electronic dispensers. For example, in one embodiment, the dispenser can be recessed into a wall as a single unit, thereby allowing for minimal space consumption by the dispenser. In other embodiments, improvements have been made to infrared detection circuitry that allows for variable sensitivity in infrared detection. Embodiments illustrated also advantageously use a minimal number of parts for both the mechanical structure and for the electronic unit. It has, therefore, an enhanced reliability and maintainability, both of which contribute to cost effectiveness. Additional improvements and advantages will be understood by those skilled in the art in light of the following descriptions.

The dispenser is an electronic touch-less (hands-free) paper towel dispenser. As will be discussed in greater detail below, hands-free operation is accomplished via two possible modes ("Hang Mode" and "On-Demand Mode"). The electronics described are located on printed circuit board(s) or the like, which are housed within a housing of the dispenser. The dispenser advantageously has a number of configurations switch settings to customize performance. These settings are located within the dispenser and are not available to the general user. They are accessible when the cover (hood) of the dispenser is unlocked and opened.

Reference is made throughout this disclosure to embodiments that employ paper towel products with the understanding that this disclosure can readily be applied to other sheet products. The term "sheet products" is inclusive of natural and/or synthetic cloth or paper sheets. Sheet products can include both woven and non-woven articles. Examples of sheet products include, but are not limited to, wipers and towels.

Referring now to FIGS. 1-5, an electronic touch-less paper towel dispenser is generally illustrated as 10. The dispenser 10 comprises a housing including a back plate 12 and a cover 14. The housing comprises a size and shape sufficient to house a full main paper towel roll and a stub roll. While the housing can be made of any suitable material, such as plastic and metals, in one embodiment steel or stainless steel are employed in the back plate 12 and/or the cover 14. A steel or stainless steel housing provides challenges to using a capacitive type proximity sensor for touch-less dispensing, as such embodiments disclosed herein employ an infrared (IR) proximity sensor.

The term infrared (IR) is being used herein to describe a form of light energy that has a wavelength of about 750 nanometers to about 950 nanometers. The light energy is above the visible spectrum of the human eye and is suitable for use as a communications medium. Like any light energy, IR light can be reflected by objects and controlled with lens. Furthermore, unlike RF (Radio Frequency), IR light is confined to a single room, but is not susceptible to RF dispensers, such as portable phones, wireless networks, remote control toys, and the like.

Figure 6:
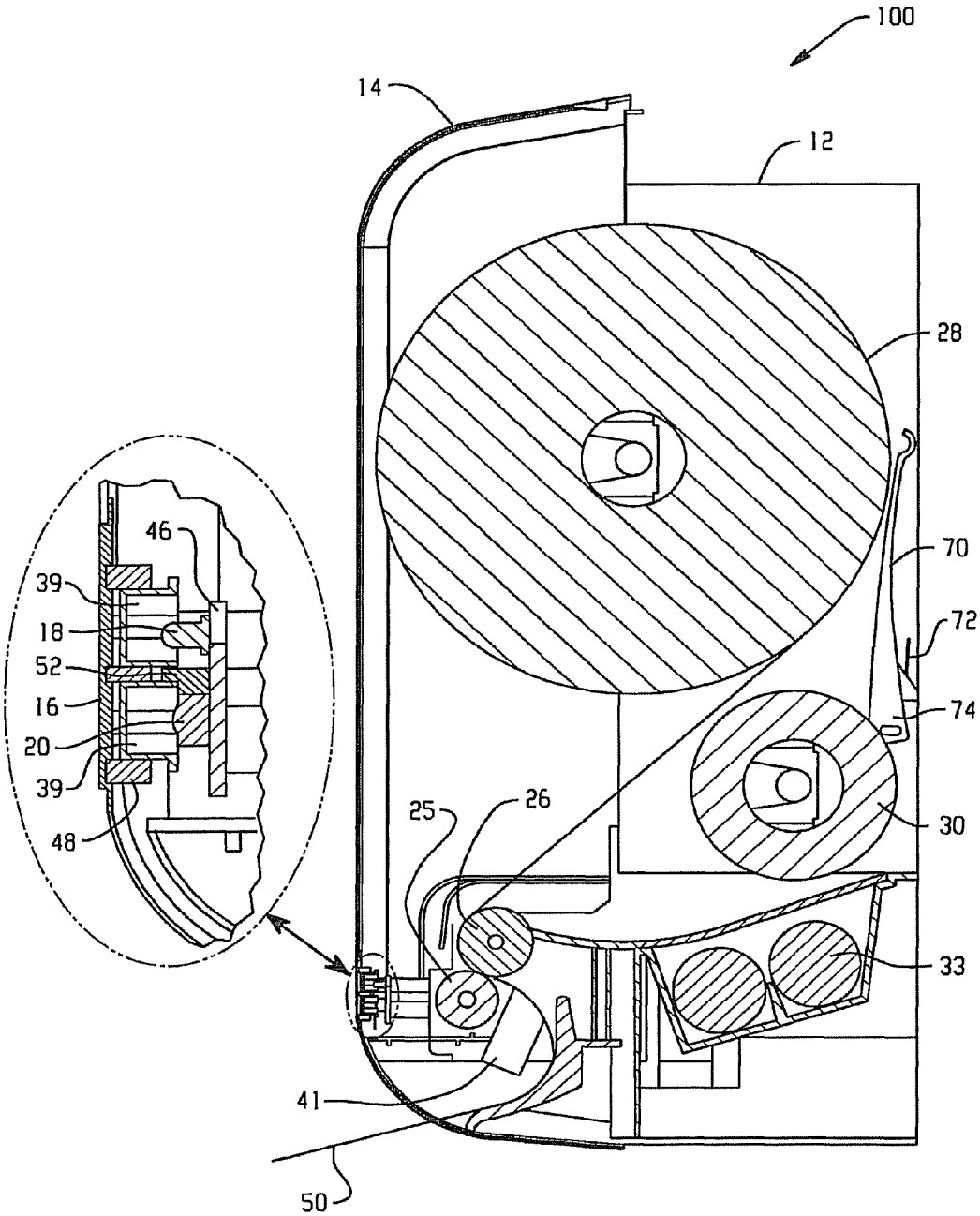
FIG. 6 is a right side view of another dispenser embodiment with portions of the cover removed.
Figure 7:
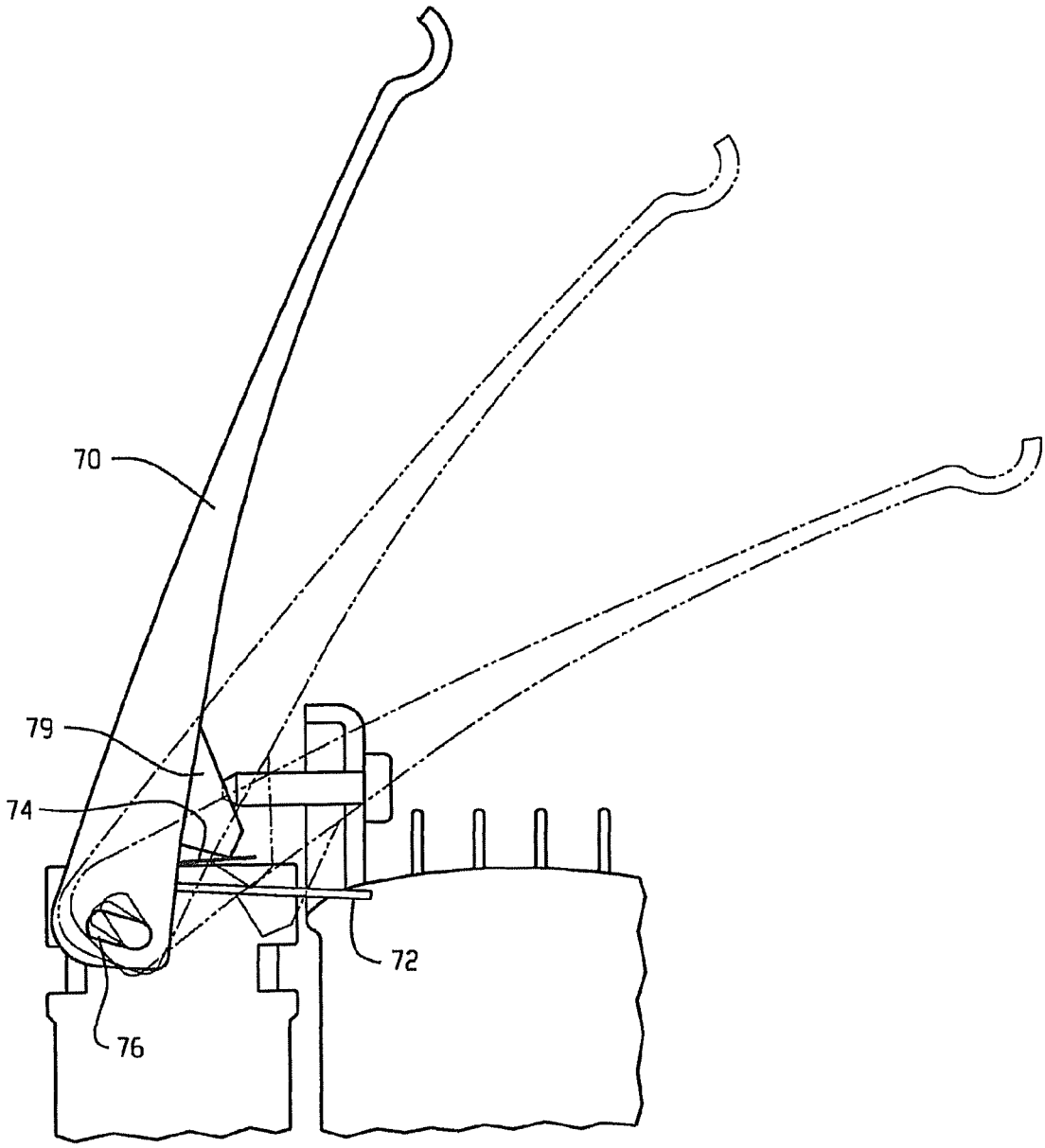
FIG. 7 is a side view of a paper level arm connected to a back plate of a dispenser embodiment.
Figure 8:
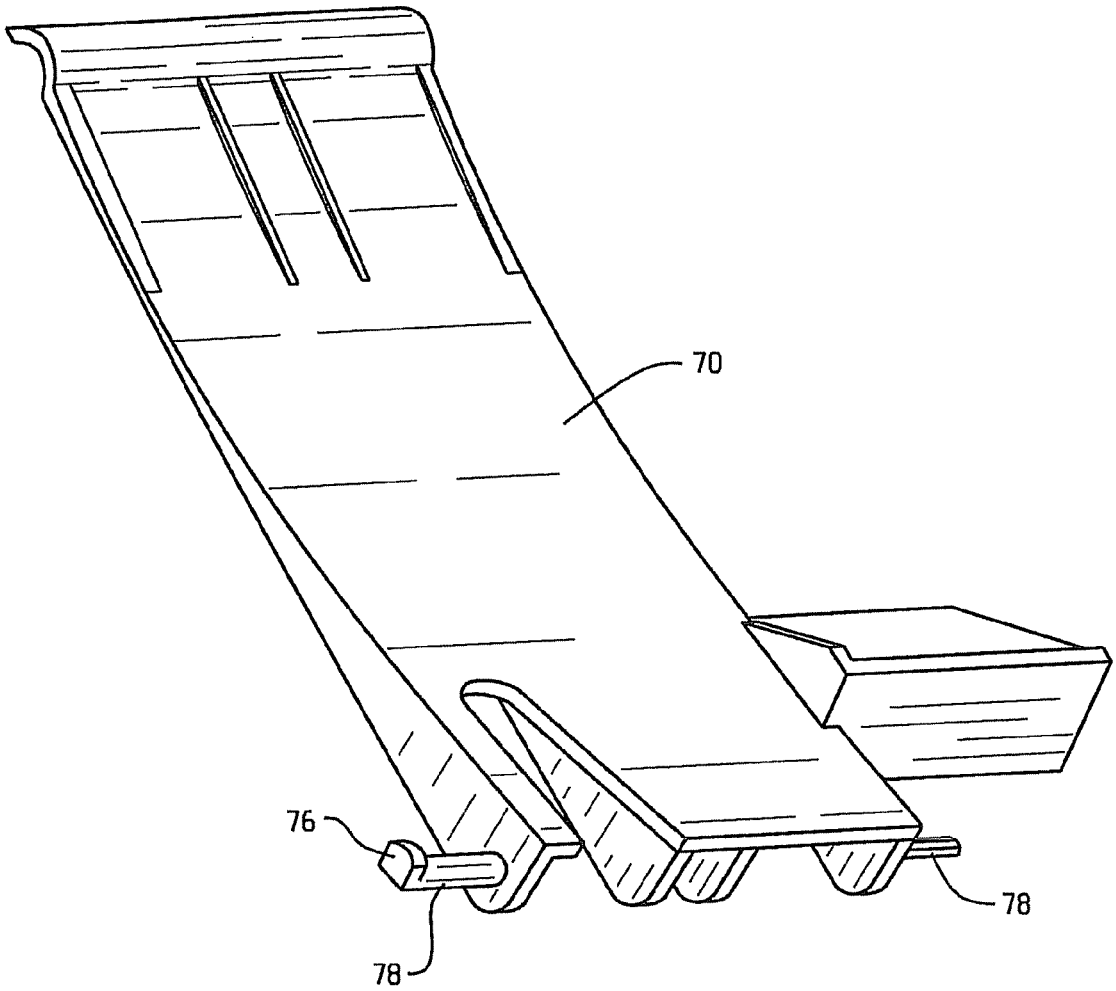
FIG. 8 is an isometric view of the paper level arm.
Figure 9:
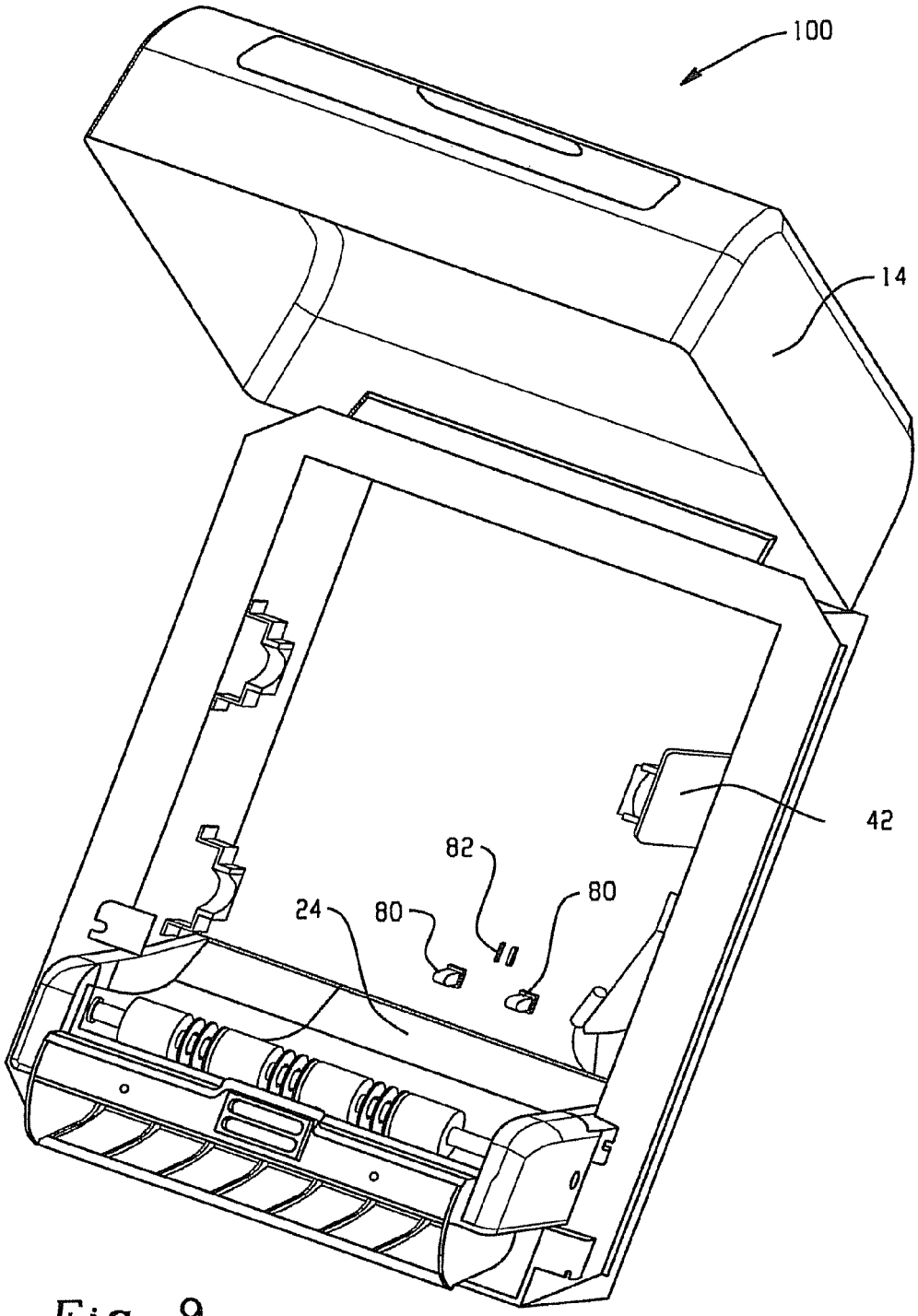
FIG. 9 is an isometric view of a dispenser embodiment showing structure for connecting the paper level arm to a back plate of the dispenser.

In one embodiment, with periodic reference to components illustrated in FIG. 6 for ease in discussion, the cover 14 further comprises an IR window 16, which may optionally be tinted. For example, the IR window may be tinted to filter out visible light (e.g., light energy that is below 650 nanometers). The location of the IR window 16 is selected such that the IR window 16 is aligned with an IR emitter 18 and an IR detector 20 disposed within the housing such that during operation, infrared light from the IR emitter 18 passes through the IR window 16, is reflected back to the IR detector 20 using any opaque object such as a person's hand. In one embodiment, to avoid unwanted detections, the maximum IR detection has been set to 4 inches by controlling the current delivered to the IR emitter 18. The IR window 16 can be located proximate to a discharge opening 22 disposed in the cover 14.

Figure 4:
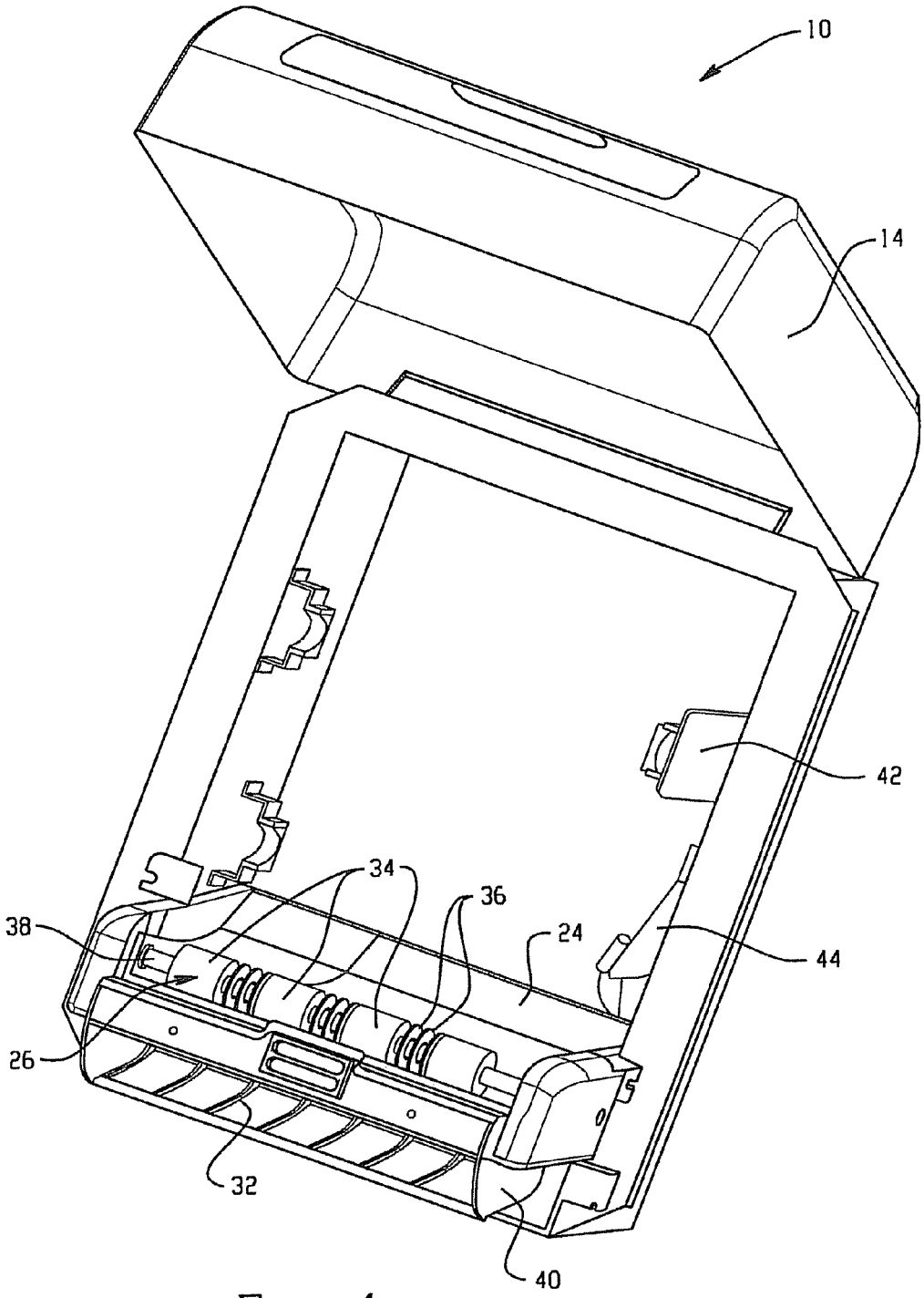
FIG. 4 is an isometric view of the dispenser with the cover open, with a paper feed mechanism assembly visible, with no paper.
Figure 5:
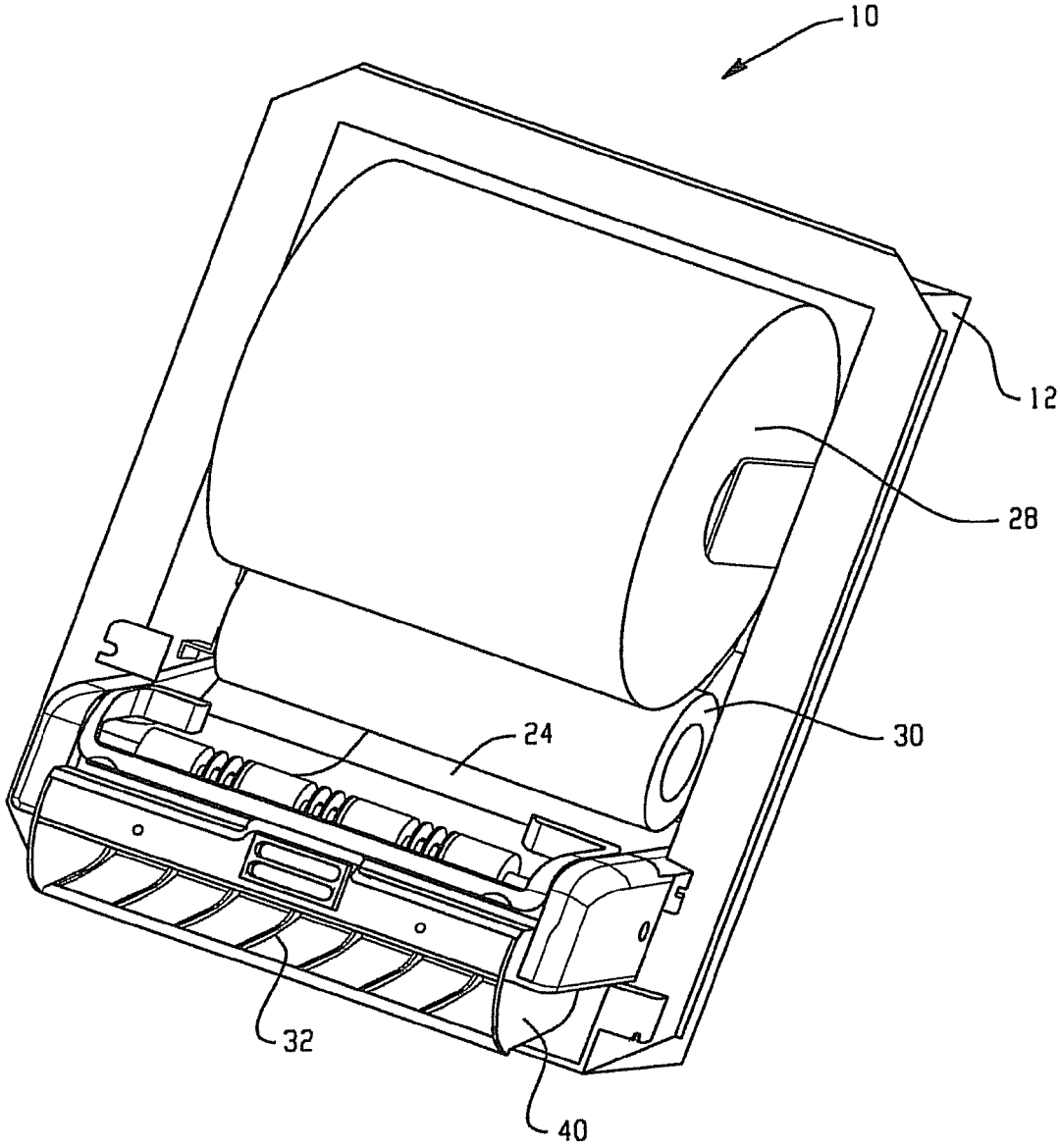
FIG. 5 is a perspective view of the dispenser with no cover, with a paper feed mechanism assembly visible, with paper rolls (main roll and stub roll)

FIG. 4 is an isometric view of the dispenser 10 with the cover 14 open, thereby illustrating the paper feed mechanism assembly 24. The paper feed mechanism assembly 24 can advantageously be designed to be self contained, that is, it can be an assembly that can easily be removed from the dispenser 10. In one embodiment, the paper feed mechanism assembly 24 is sized to accommodate 8.25 inch wide paper. The paper feed mechanism assembly 24 comprises a feed roller 26. The feed roller 26 serves to feed the paper towels 28 (main roll) and 30 (stub roll) (FIG. 5) being dispensed onto the optional curved dispensing ribs 32 of dispensing shelf 40. The optional curved dispensing ribs 32 are curved and have a low area of contact with the paper towel dispensed (not shown). If the dispenser 10 becomes wet, the curved dispensing ribs 32 help in dispensing the paper towel by providing low friction and by holding the dispensing towel off of the wet surfaces it would otherwise contact.

The feed roller 26 is typically as wide as the paper roll and includes drive roller 34 and intermediate bosses 36 on the drive shaft 38. The working drive rollers or drive bosses 34 are typically an inch or less in width, with intermediate bosses 36 located between them. In one embodiment, the intermediate bosses 36 are slightly less in diameter than the drive rollers or drive bosses 35. This configuration of drive rollers or drive bosses 34 and intermediate bosses 36 tend to prevent the dispensing paper towel from becoming wrinkled as it passes through the drive mechanism assembly and reduces friction, which advantageously reduces power consumption to operate the feed roller 26 compared to designs with feed rollers having a relatively high surface contact with the paper towel.

Also illustrated in FIG. 4 is an embodiment where towel arms 42 and towel arms 44 are disposed in physical communication with the back plate 12. The dispenser 10 is particularly intended to dispense paper from a continuous roll. The dispenser 10 can accommodate two rolls of paper, a main roll 28 and a partial, "stub" roll 30. Towel arms 42 act to retain the main roll 28 in the housing, while towel arms 44 act to retain the stub roll 30. When the main roll is reduced to a diameter of about 3.0 inches, it can be manually transferred from the top position roll holder (removed from towel arms 42) to the bottom position roll holder (retained in towel arms 44).

Figure 10:
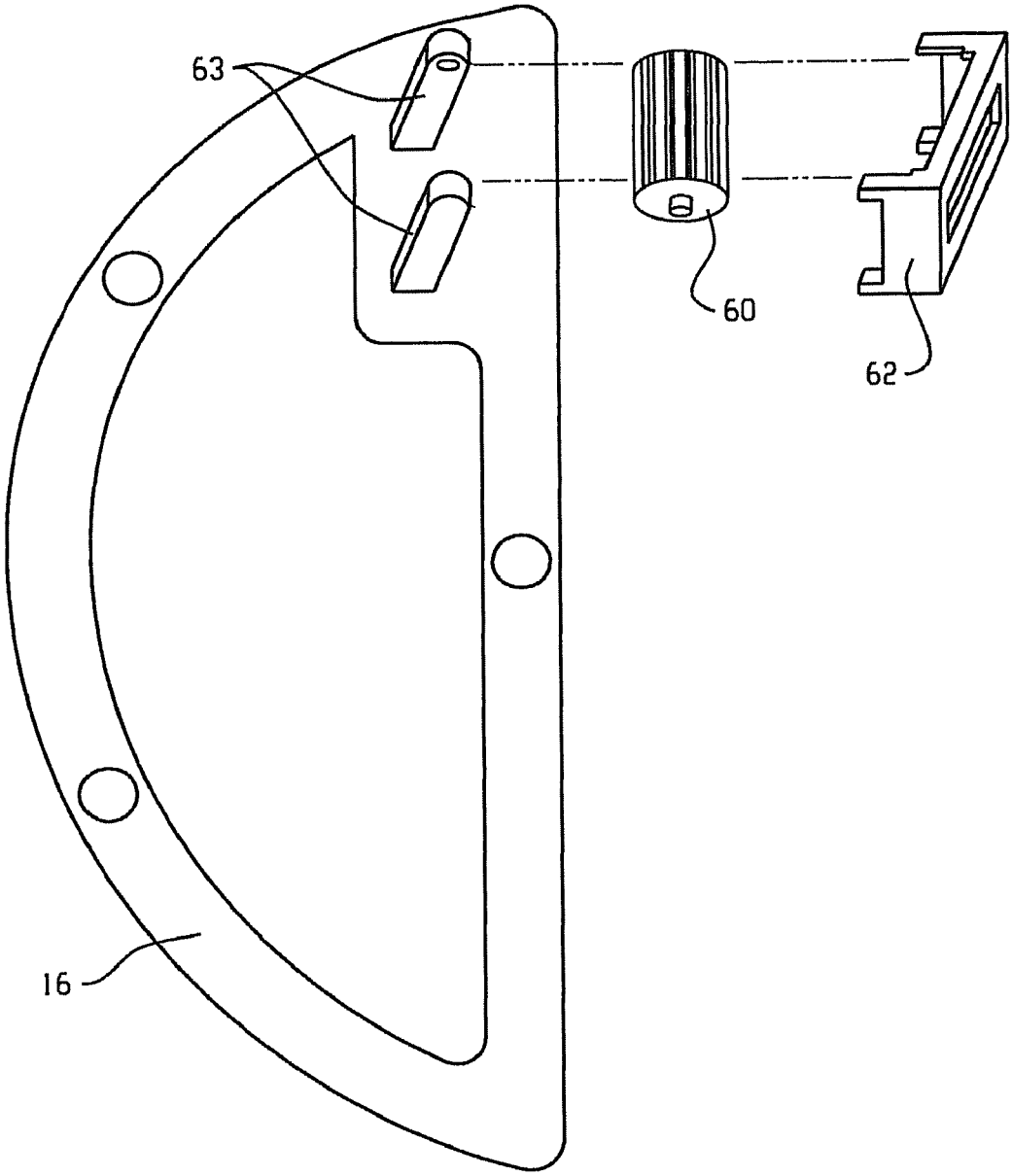
FIG. 10 is an exploded view of a back side of a window showing a magnet and a retainer.
Figure 11:
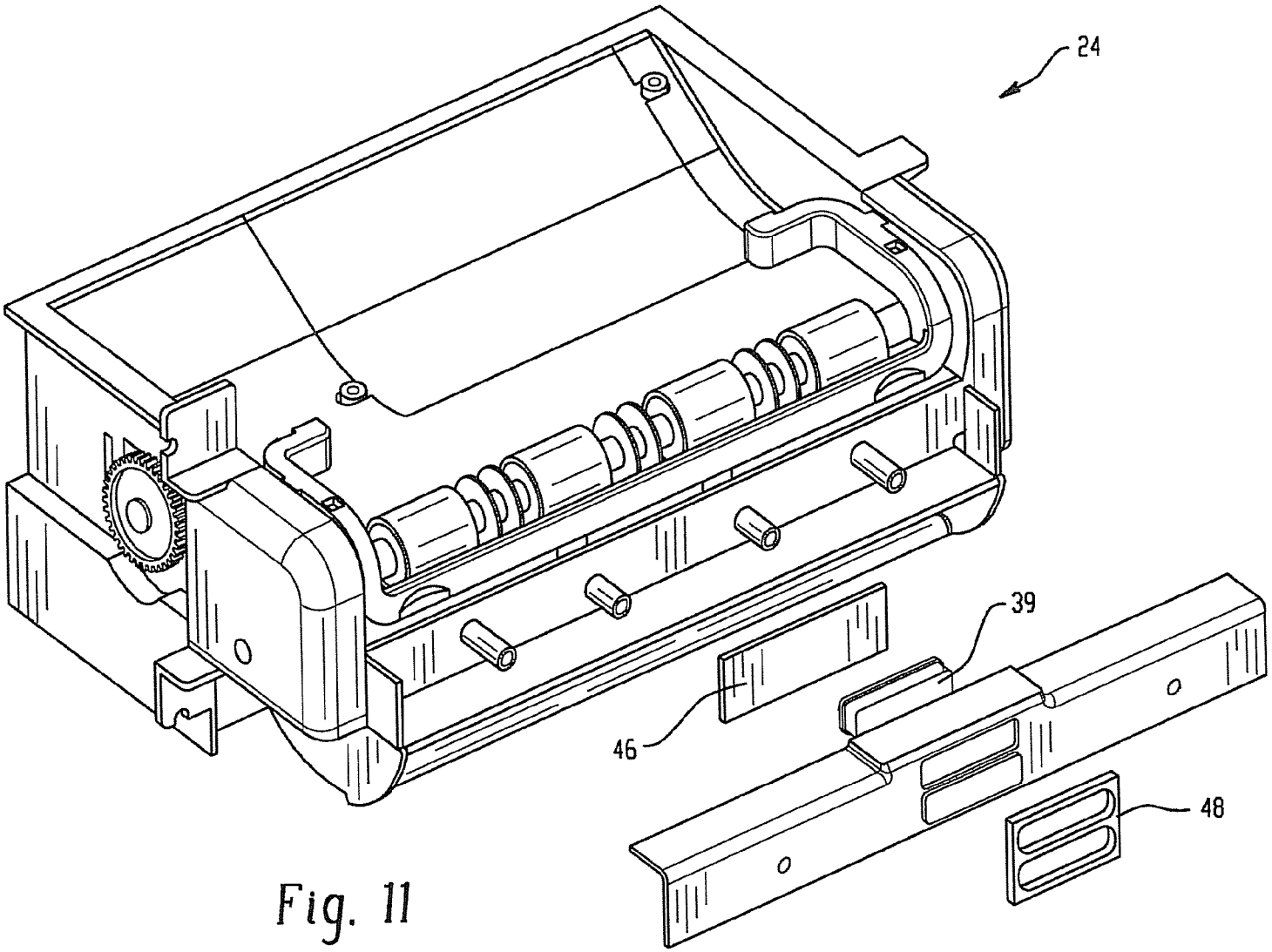
FIG. 11 is an exploded isometric view of a feed mechanism assembly for a dispenser embodiment illustrating an infrared sensor assembly.
Figure 12:
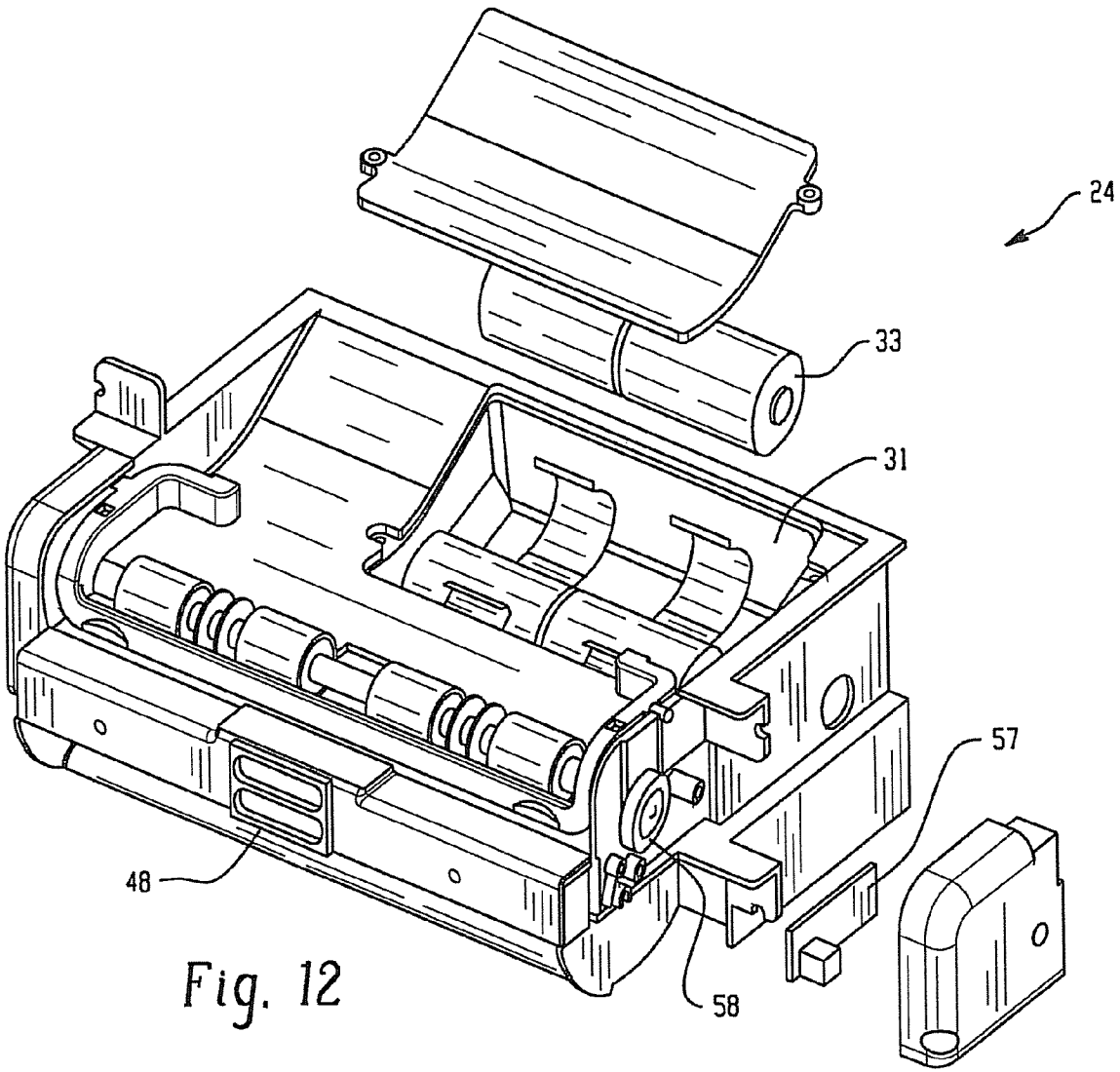
FIG. 12 is an exploded isometric view of a feed mechanism assembly for a dispenser embodiment illustrating a battery compartment with chassis cover removed.
Figure 13:
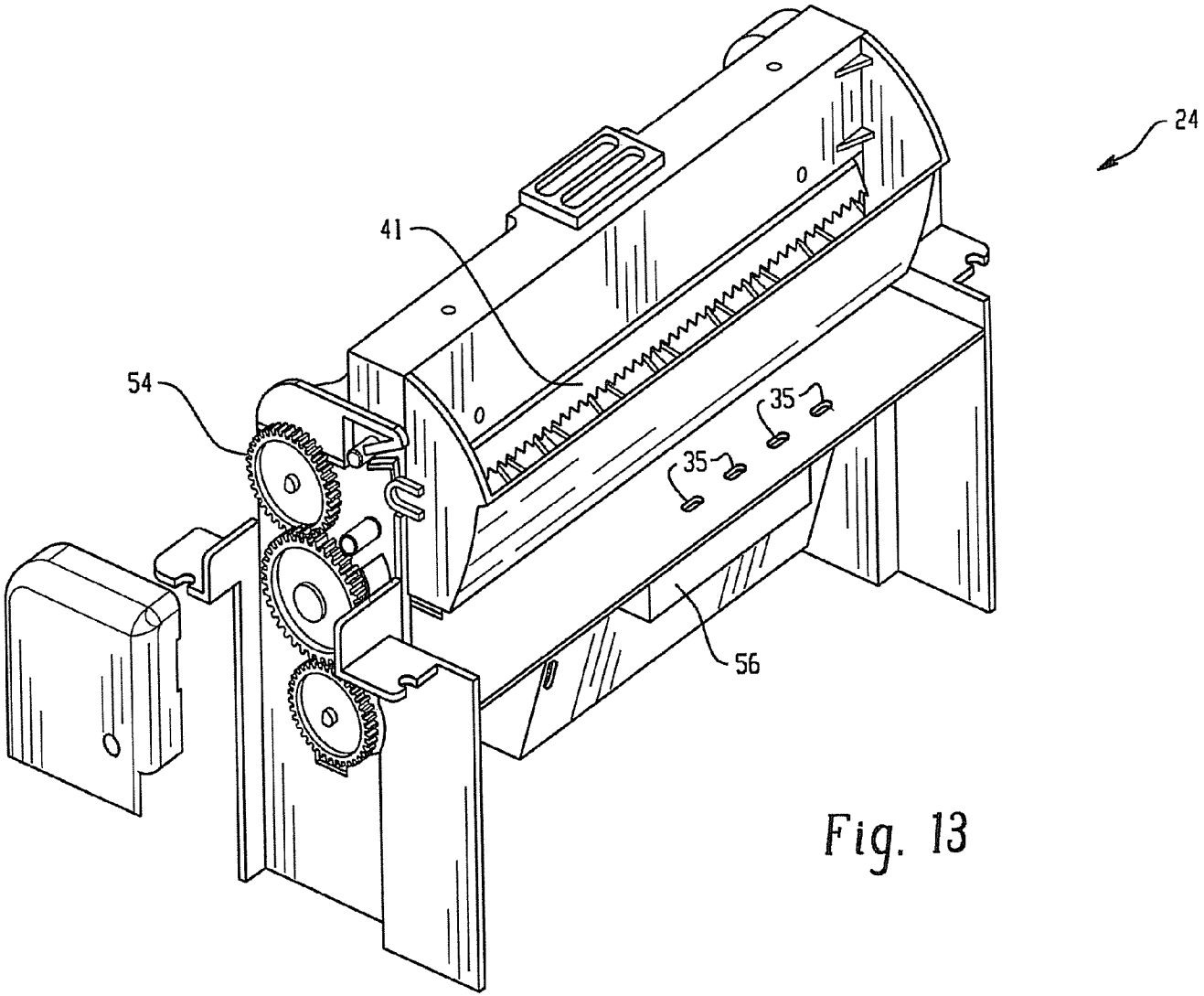
FIG. 13 is an exploded isometric view of a feed mechanism assembly for a dispenser with a chassis cover removed to illustrate a gear train of a dispenser embodiment.
Figure 14:
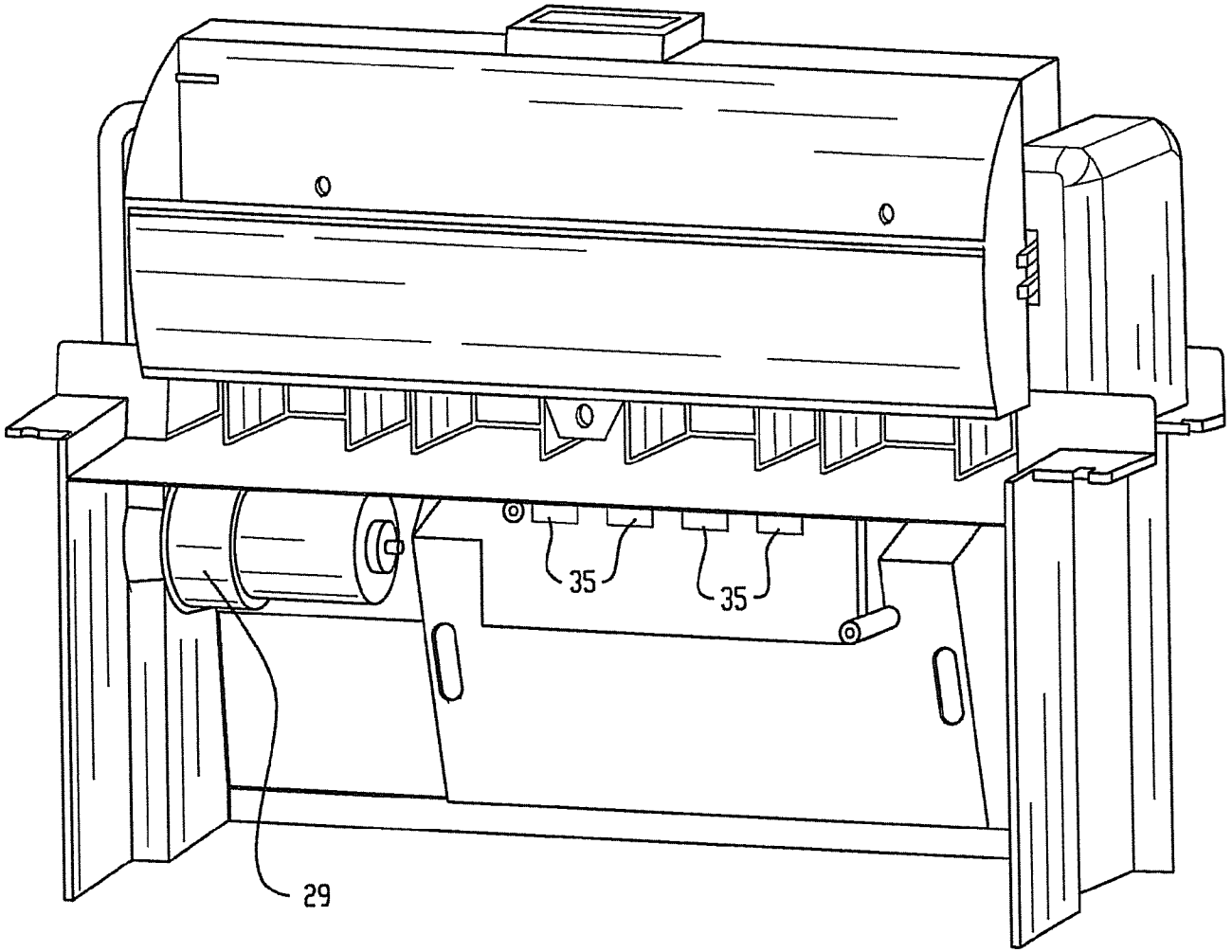
FIG. 14 is an isometric bottom view of a feed mechanism assembly illustrating a motor mounting and microcontroller unit printed circuit board for a dispenser embodiment.

In one embodiment, a hinge may connect the cover 14 to the back plate 12. The hinge may be provided at an upper portion of the cover (i.e., a location opposite the dispensing portion). Alternatively, the hinge may be located either at a right or left side of the dispenser 10. In one embodiment, as illustrated in FIG. 10, a magnet 60 can be connected to a back side (i.e., the side facing the inside of the dispenser 10) of IR window 16 by a retainer 62. The IR window 16 may be a molded component having tongues 63, which are engaged by the retainer 62 to hold the magnet 60 in place. In operation, a magnetic reed switch on a circuit board (e.g., infrared sensor circuit board 46 illustrated in FIG. 6) may be triggered by the magnet 60 connected to the hinged cover 14. In other words, the magnetic reed switch can be used in the logic of the circuit board 46 to determine if the cover 14 is in a closed or open position. While use of the magnet 60 and magnet reed switch allows for some tolerances and/or flexibility in designing the manner in which the cover 14 opens, it is to be understood that other embodiments are also envisioned where a mechanical closure mechanism is employed with a mechanical limit switch on a circuit board being employed to determine if the cover 14 is in a closed or open position.

Referring now to FIGS. 6-9, an electronic touch-less paper towel dispenser is generally illustrated as 100. In one embodiment, the dispenser 100 may include an electronic paper level sensor assembly including a paper level arm 70 and a limit switch 74 in communication with a microprocessor unit. The paper level arm 70 pivots about an axis defined by stub shafts 78, which are secured upon the back plate 12 of the housing by a pair of retainers 80. At least one stub shaft 78 includes a hook end 76 to help minimize inadvertent release of the level arm 70 from retainers 80. A spring 72 provides a bias force tending to displace an upper end of level arm 70 away from the back plate 12 of the dispenser and into engagement with the outer surface of the paper roll 28. Spring 72 may be a torsion spring having a pair of linear ends. Spring 72 is retained upon a stub shaft 78 with one end engaging a spring end retainer 82 (channel) upon the back plate 12 and the other end engaging an extension 79 of the level arm 70.

Level arm 70 engages a paper roll 28 and pivots about stub shafts 78 as the diameter of the paper roll decreases. In operation, lever arm 70 pivots between a full roll orientation and a low paper orientation. Extension 79 of level arm 70 engages limit switch 74, and as the paper level decreases the limit switch 74 is triggered. The microprocessor detects a change in limit switch 74 condition caused by a lower paper condition and activates an LED or other visual signaling device to indicate the lower paper condition.

Level arm 70 engages the paper roll 28 and advantageously imparts a retarding force tending to control the free rotation of the paper roll 28 during release. In this manner, level arm 70 minimizes paper jamming by preventing the uncontrolled release of paper from the roll.

Figure 15A:
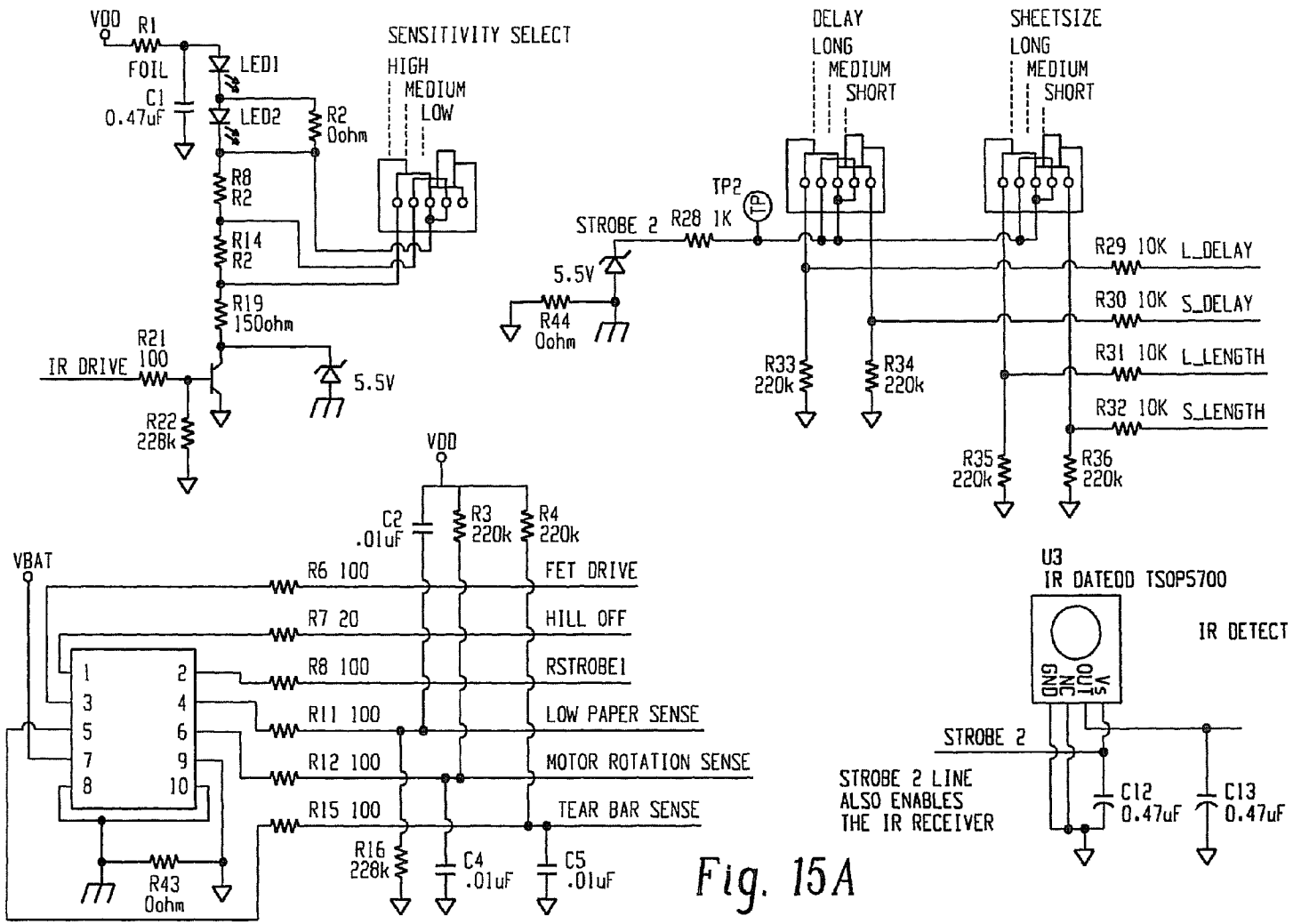
FIG. 15A is a schematic of a first portion of a microcontroller unit printed circuit board for a dispenser embodiment.
Figure 15B:
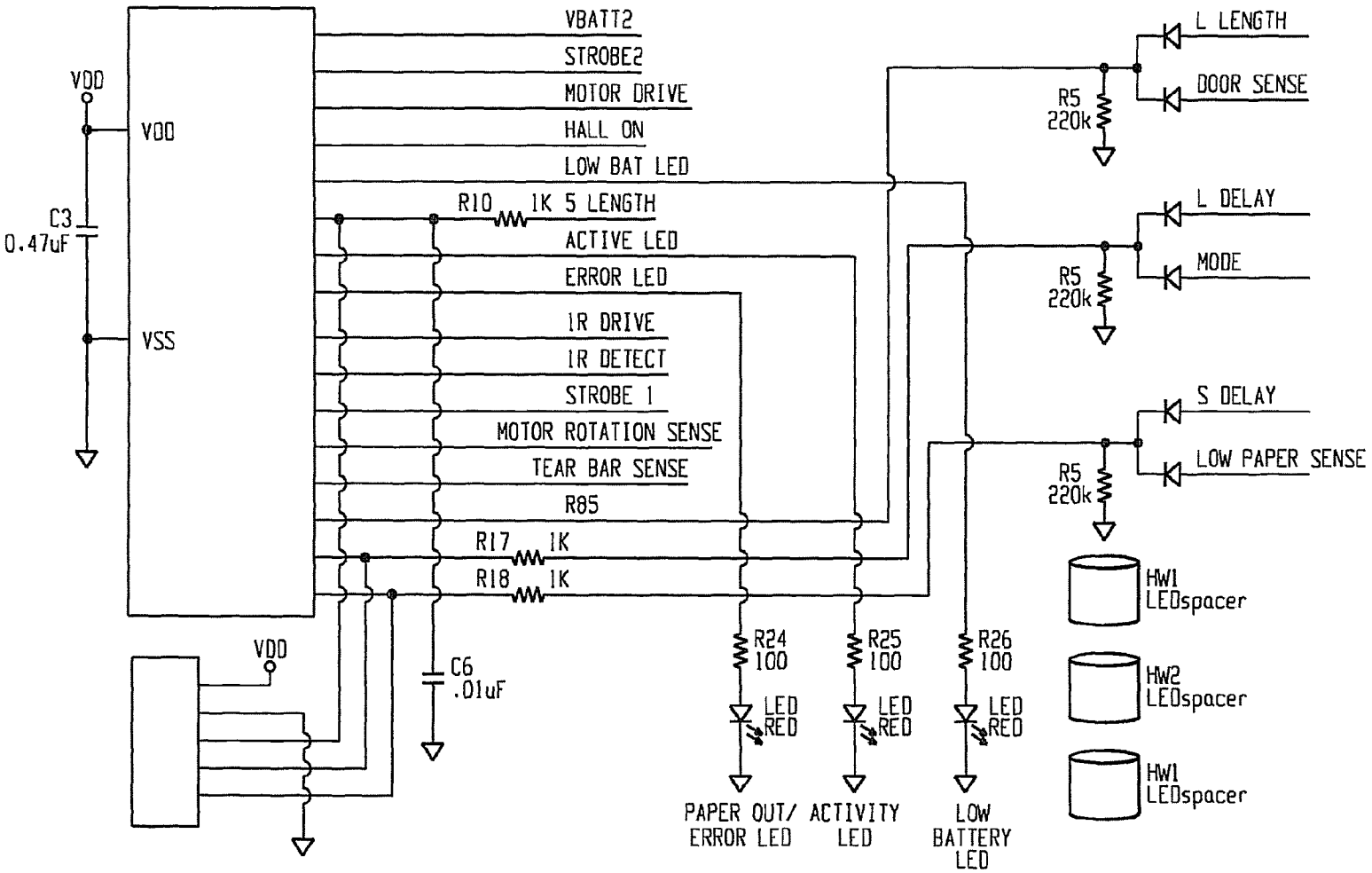
FIG. 15B is a schematic of a second portion of the microcontroller unit printed circuit board for the dispenser.
Figure 15C:
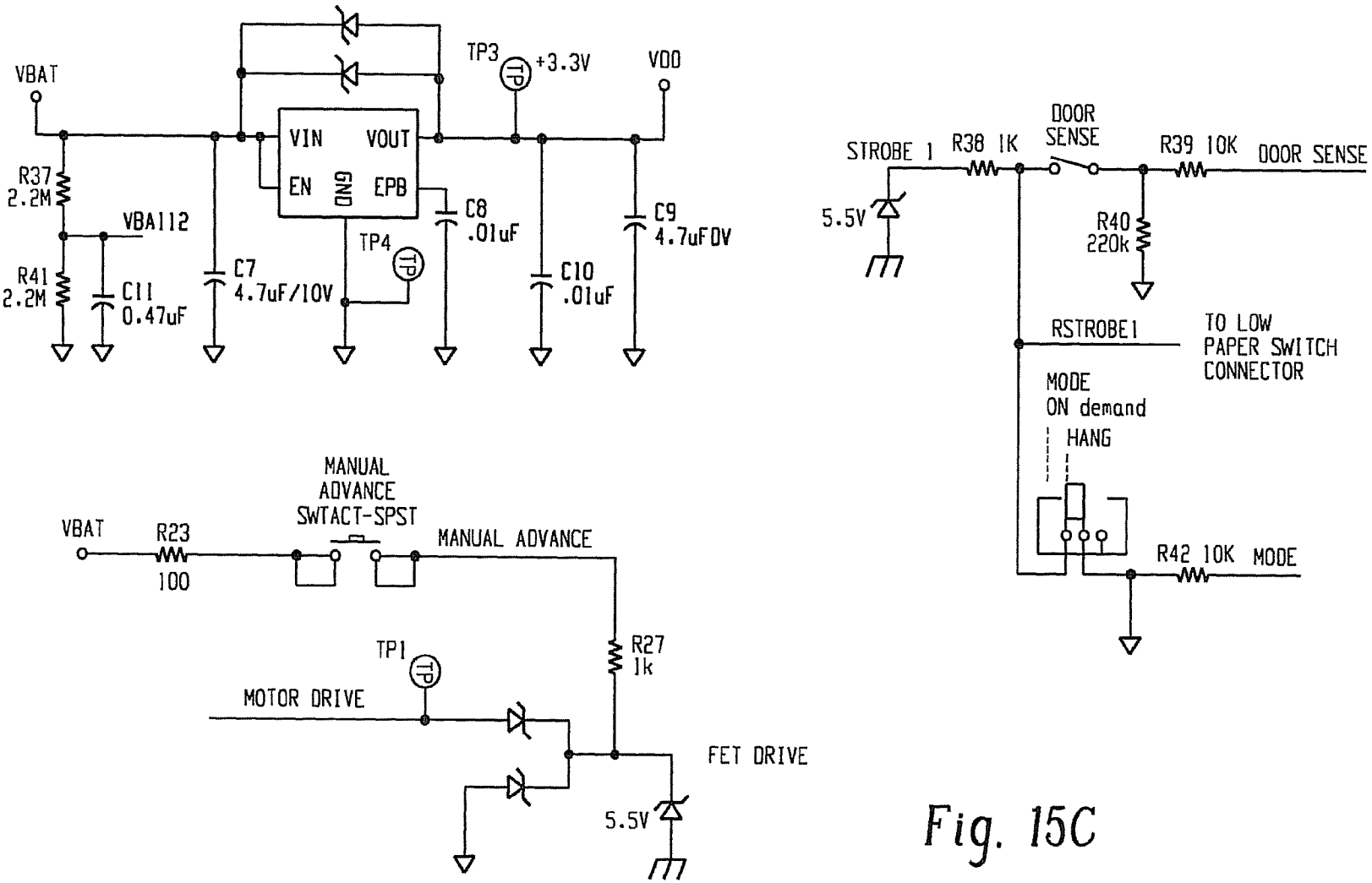
FIG. 15C is a schematic of a third portion of the microcontroller unit printed circuit board for the dispenser.

Referring to FIG. 6, as well as FIGS. 15A-15C, the circuit board 46 of dispenser 100 comprises, among other things, the IR emitter 18, the IR detector 20, and an IR barrier 52. The IR emitter 18 and IR detector 20 are separated by the IR barrier 52, which can comprise an opaque material to prevent cross-talk and/or interference. The IR emitter 18 and IR detector 20 can optionally be protected by clear lenses 39 to prevent damage to the IR sensor, when the dispenser cover 14 is in the open position. An optional gasket 48 may be used to seal around the clear lenses 39 to provide an opaque barrier between the clear lenses 39 and the IR window 16 attached to the cover 14. The gasket 48 can comprise a material suitable for blocking light, while allowing for ease in manufacturing. For example, the gasket 48 can comprise a foam rubber material.

In one embodiment, the IR emitter 18 uses an IR diode as the active part of the circuit. A current-limiting resistor is placed between an anode of the IR emitter 18 and a supply voltage. The supply voltage can be 3.3 volt (V), regulated to protect the IR diode from over-current failure. A cathode of the IR emitter 18 is connected to a 3-pole slide switch and a series of resistors. Switching to different positions on the slide switch selects different sets of series resistors, which raises or lowers a total series resistance and allows for higher lower currents through the IR emitter diode. This has the effect of higher lower intensity of IR light being emitted, and therefore changes the maximum effective distance of the reflected IR light energy. An IR pulse train can provide error-free motion detection and filter out interference from external dispensers such as fluorescent lamps, portable phones, cameras, and similar dispensers.

The IR detector 20 of the circuit senses the presence of IR light energy at a predetermined frequency. In one embodiment, when the predetermined frequency of IR light energy is detected, the IR detector 20 uses an internal open collector output, driving the base of an NPN transistor to supply an active (high), and signaling the microprocessor that an active IR reflection has been detected. When the predetermined frequency of IR light energy is not present, or too low in intensity, the detector output returns to an inactive state (low).

The IR barrier 52 directs the IR light energy in a forward direction and protects the IR detector 20 from false triggers that may be caused by the close proximity to the IR emitter 18. The IR barrier 52 also allows for lenses 39 to be used as protection for the IR sensor circuits. In one embodiment, the IR barrier 52 extends from a printed circuit board (PCB) surface to a backside surface of the lens cover, and is made of a material that blocks IR light energy. For example, a variety of different black plastic materials (e.g., rubber foam) are suitable as an IR light barrier.

Referring now to FIG. 6 and FIGS. 11-13 additional features of the dispenser 100 are illustrated. In one embodiment, a tail paper 50 from roll 28 is feed from the bottom of the roll and extends between the feed roller 26 and pinch roller 25. The pinch roller 25 is spring loaded and applies pressure to the feed roller 26, which in turn feeds the paper. During dispensing, a motor 29 drives a gear train 54, which in turn drives the feed roller 26.

The motor 29 may be driven by at least one battery or driven off a 100V or 220V AC hookup, or driven off a transformer which is run off an AC circuit. The batteries may be non-rechargeable or rechargeable. In one embodiment, the motor and any other electrical components in the dispenser 100 may be powered by four 1.5 volt batteries 33 (6 volts DC).

The batteries are housed in a battery compartment 31. Power from the batteries 33 is also supplied to the microprocessor circuit board 56.

Power and signals are distributed from the microprocessor board 56 to the motor 29, the switch printed circuit board 57 and the infrared sensor circuit board 46 via wire harnesses as the circuitry and software dictate. In one embodiment, the microprocessor board comprises a microprocessor and four slide switches 35 to determine sheet length, sheet delay, activation sensor sensitivity and dispense mode (hang or on-demand).

A tear bar mechanical limit switch 58, which is in operable communication with the tear bar 41, may also feed to circuit boards 46, 57. During operation, user action is detected by a tear bar 41. This serrated bar perforates the paper sheet as the user pulls to tear off. Set on a pivot point, the tear bar 41 action also engages (then releases) a switch mechanism, thus informing the electronics of user activity. A time delay between sheet feeds (configurable) is designed to allow a pause between dispensing.

In one embodiment, the circuit boards 56, 57, either alone or in combination, can comprise a manual feed switch, low battery LED, a Hall effect sensor to sense the feed roller 26 position, a magnetic reed switch to indicate if cover is closed/open, respective electrical components and circuitry. Components of boards 56, 57 may be combined on a single board or be positioned on different boards.

Referring to FIGS. 15A-C and 16-17 with periodic reference to elements found in FIGS. 1-4, and 10, the electronics hardware design is illustrated and may be embodiment in one or more printed circuit boards (PCBs) (e.g., circuit boards 56 and 57). In one embodiment, circuit boards 56 and 57 connect via right angle connectors. One board (e.g., circuit board 56) holds the microcontroller unit (MCU), as well as configuration switches, LEDs, and the like. The second PCB can accept power, handle motor drive, as well as other tasks. Both boards share the same power source and are connected together for proper operation.

In one embodiment, the MCU is the Microchip PIC16F88. Key features of PIC16F88 include, but are not limited to, nanowatt low power sleep mode, internal ADC (analog to digital conversion), internal oscillator, and 4k ROM program space. To conserve battery life, the MCU spends greater than or equal to 99% of its time in low power sleep mode. It awakes according to its internal programmed timer and determines if paper needs to be ejected. If a sheet does need ejecting, the MCU powers up other circuitry for the tasks, monitors the dispensing, and then goes back into sleep mode.

In one embodiment, the dispenser (10, 100, see FIGS. 1-6) can have two modes of operation: Hang Mode and On-Demand Mode. Detail discussion about each mode of operation follows.

During Hang Mode, on power up, the dispenser 10, 100 initializes itself and assumes the cover 14 is open. Once the cover 14 is determined to be closed, the dispenser 10, 100 waits five seconds and then enters normal operation. The activity light emitting diode (LED) indicator, which is visible via IR window 16, lights for the specified delay duration and a sheet is ejected. The LED remains lit for the duration of the inter-sheet delay to let the user know it is busy and not able to respond. When the hanging sheet is torn off, the configured inter-sheet delay begins. Once this time period has elapsed, the program loop begins again, lighting the LED and ejecting another sheet. As its name suggests, hang mode leaves a sheet hanging from the dispenser.

During On-Demand Mode, on power up, the dispenser 10, 100 initializes itself and assumes the cover 14 is open. Once the cover 14 is determined to be closed, a five second delay is provided. The MCU enters low power sleep mode. Every 100 milliseconds (ms), the MCU wakes up and activates an infrared (IR) beam for a short burst (micro seconds). IR window 16 allows the IR beam out of the dispenser 10, 100. If a hand (or similar object) is placed such that the beam is reflected back to the dispenser 10, 100, detection is made and a sheet is dispensed. If no detection is made, the MCU returns to low power sleep mode for another 100 ms.

After the user tears off the dispensed sheet, the configured inter-sheet delay elapses. After this delay, the 100 ms wake/IR beam sequence begins again. This pause ensures a minimum delay between possible hand detects and sheet feeds. As with Hang Mode, the Activity LED lights during this pause to inform the user that the dispenser 10, 100 is busy. The Activity LED can also light upon detection of a hand, as well as during the dispensing of a sheet.

To conserve power, the IR beam is turned on 10 times a second (i.e., every 100 ms). Thus, a fast hand waved in front of the dispenser may sometimes be missed. Reliable detection is made by a stationary hand that is present in front of the IR window 16 for more than one-tenth of a second. Stated another way, the dispenser 10, 100, in at least one embodiment, is not a motion-activated dispenser, but instead is a physical presence sensing dispenser (e.g., a dispenser that detects the presence of a human hand or other object).

In one embodiment, the IR detector 20 may be tuned to detect 455 kilohertz (kHz) pulse trains and may need 6 pulses to 10 pulses to determine its response. Upon detection, the IR detector 20 asserts its output line to the MCU. To avoid false detections (e.g., random ambient light, reflections, electronic interference, and the like), the MCU samples the IR detectors output 8 times. If all 8 samples are positive (i.e., steady hand detect), then the firmware declares a detection. If fewer then 8 detects are noted, the firmware declares no detect. This voting process happens every time the MCU wakes up and generates the IR beam.

Initialization for both modes is the same. After power up (or any reset), the key configuration registers are updated. This includes timing registers (for watch dog time-out, IR beam frequency generation, and the like), analog to digital conversion module (for battery voltage sampling), port IO pins (direction and start up output states), and clearing the shadow registers for program use. For both modes, the MCU goes into low power mode (SLEEP) as often as possible to conserve power. Every 100 ms the dispenser wakes itself up, performs the current task at hand, and then goes back to sleep.

In addition to powering down the MCU to save power, the dispenser 10, 100 also powers down other electronics when not in use. This includes a Hall sensor (for motor rotation/sheet length) and the IR transmitter/receiver (for On Demand Mode.) Furthermore, to conserve power, error LEDs can be either off; or blink at 10% duty. In one embodiment, the error LEDs are never continuously on. Status LEDs (such as the activity LED) are lit continuously during activity. It is noted that when dispensing a sheet, the MCU is on 100% of the time in order to monitor the sheet length. Essentially no power would be saved by sleep mode during a sheet dispenser, since the motor drive current is one-thousand times greater than the microcontroller current draw in at least one embodiment.

System Components

Multiplexed IO Switch Settings

Due to limited IO pin count on the MCU, some signal inputs are multiplexed together. Three of the MCU's input pins have more than one signal on them:

| | |
|---|---|
| RB5: | L_LENGTH or DOOR_SENSE |
| RB6: | L_DELAY or MODE |
| RB7: | S_DELAY or LOW_PAPER_SENSE |

These signals are ORed together with external diodes in hardware. The signals are not active all the time, as this would create electrical conflicts. Instead, two strobe lines controlled by the microcontroller are used to power one line pair or the other. By knowing which strobe line is active, the microcontroller firmware can tell which signal is being reported at the multiplexed input pin. For example:

Ddd STROBE_1 asserts DOOR_SENSE, MODE, and LOW_PAPER_SENSE.
STROBE_2 asserts L_LENGTH, L_DELAY, and S_DELAY.

If the microcontroller asserts strobe_1, it knows RB5 will report the status of DOOR_SENSE. If the microcontroller asserts strobe_2, it knows RB5 will report the status of L_LENGTH. Both strobe lines are not powered at the same time.

By diode ORing lines together and driving from a microcontroller port pin, a diode drop is unavoidable. This means the input port pin should have a logic '1 ' threshold lower than the supply Voltage less one diode drop. The PIC16F88 has two types of input pins, CMOS and Schmitt trigger. Schmitt trigger inputs employ a voltage of 0.8×Vcc=2.64 V for a logic level '1 '. Thus, any diode drop must be significantly less than 3.3−2.64=0.66 V. Since diode drops are on the order of 0.6-0.7V, Schmitt trigger inputs were avoided for the diode ORed inputs. The CMOS/TTL logic level input pins were used instead as their logic level '1 ' is 1.6 V.

3.3V (supply)−0.6 (diode drop)=2.7V>1.6V (CMOS logic '1 ').

To provide against noise glitches, debouncing on switch inputs is performed during every read. Switches are sampled every 5 seconds.

Sheet Length

This slide switch (see "SHEET SIZE" in FIG. 15A) sets the sheet length dispensed: short, medium, long. It applies to both Hang Mode and On Demand Mode.

Delay

This slide switch (see "DELAY" in FIG. 15A) sets the delay time between sheet feeds: 1 second, 2 seconds, 3 seconds. It applies to both Hang Mode and On Demand Mode.

Sensitivity

This slide switch (see "SENSITIVITY SELECT" in FIG. 15A) sets detection range for On Demand mode: close, near, far. This setting only applies to On Demand Mode.

Mode

This slide switch (see "MODE" in FIG. 15C) sets the mode: Hang Mode or On Demand Mode.

Door Switch

The door switch detects if cover 14 of dispenser 10, 100 is open. When the door (e.g., cover 14) is in the closed position, a magnet 60 in the door comes in close proximity to a mechanical reed switch, closing it and thus providing mechanical/electrical contact. The open/closed state of the reed switch is monitored by the MCU. The Door Switch is monitored every five seconds during idle mode. During a sheet dispense, the door in continuously monitored. If the door is opened during motor activity (i.e., a sheet feed), the MCU aborts the feed and disables the motor as a safety precaution.

Low Paper Switch

The low paper switch assembly, including level arm 70, is connected to a mechanical switch that monitors paper level on the roll. When a minimum roll diameter is detected (low paper condition), the switch is closed. In one embodiment, once latched, the only way to clear a low paper condition is to open the door to the dispenser (which resets the MCU.) An out of round condition on paper roll may cause the low paper switch to open and close as the roll rotates. This does not affect low paper detection. The first time the low paper condition is noted, the low paper condition is latched by the MCU.

IR Transmitter

The IR transmitter is a 400 kHZ to 500 kHz pulse train generated by the microcontroller's hardware PWM module. This signal drives the base of a transistor, which in turn draws current through a pair of IR LEDs hooked in series. Since pulse train generation is handled in hardware, proper waveform timing does not depend on firmware execution time, instruction cycles, loop timing, and the like. IR LED "on time" is not 50% duty (i.e., on half of the time, off half of the time). In one embodiment, to reduce power consumption, the duty ("on time") has been reduced to about 25%. This is a compromise between reducing the current draw as much as possible, while still ensuring proper pulse width for the IR detection circuitry. In one embodiment, the sensitivity switch allows three different settings for IR transmit power. It selects different combinations of series resistors that limit the current flow through the IR LED(s). Lower current results in lower transmitted power.

IR Receiver

In one embodiment, the IR receiver (detector) is tuned to detect a 455 kHz pulse train. It may need 6 pluses to 10 pulses to determine its response. Upon detection, the IR receiver asserts its output line to the MCU. To avoid false detections (random ambient light, reflections, electronic interference, and the like) the MCU samples the IR receiver output 8 times. If all 8 samples are positive (i.e. steady hand detect), then the firmware declares a detection. If fewer then 8 detects are noted, the firmware declares no detect. The microcontroller PWM hardware is incapable of producing a 455 kHz pulse train, hence the next closest setting of 500 kHz. This frequency is still within the IR receiver's detection band, though with a reduced sensitivity.

Shaft Rotation (Determining Sheet Length)

Figure 16A:
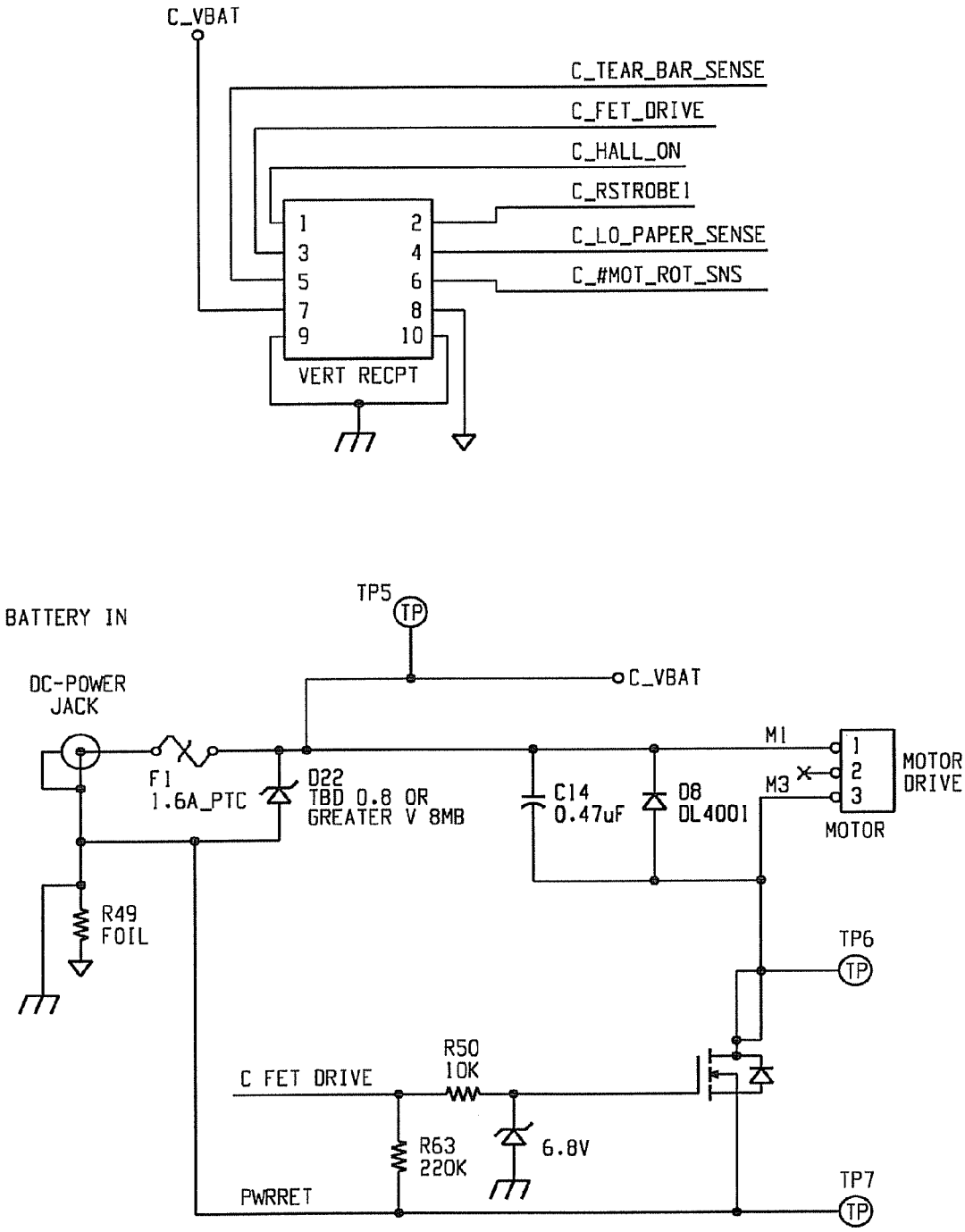
FIG. 16A is a schematic illustration of a first portion of a connector circuit board for the dispenser.
Figure 16B:
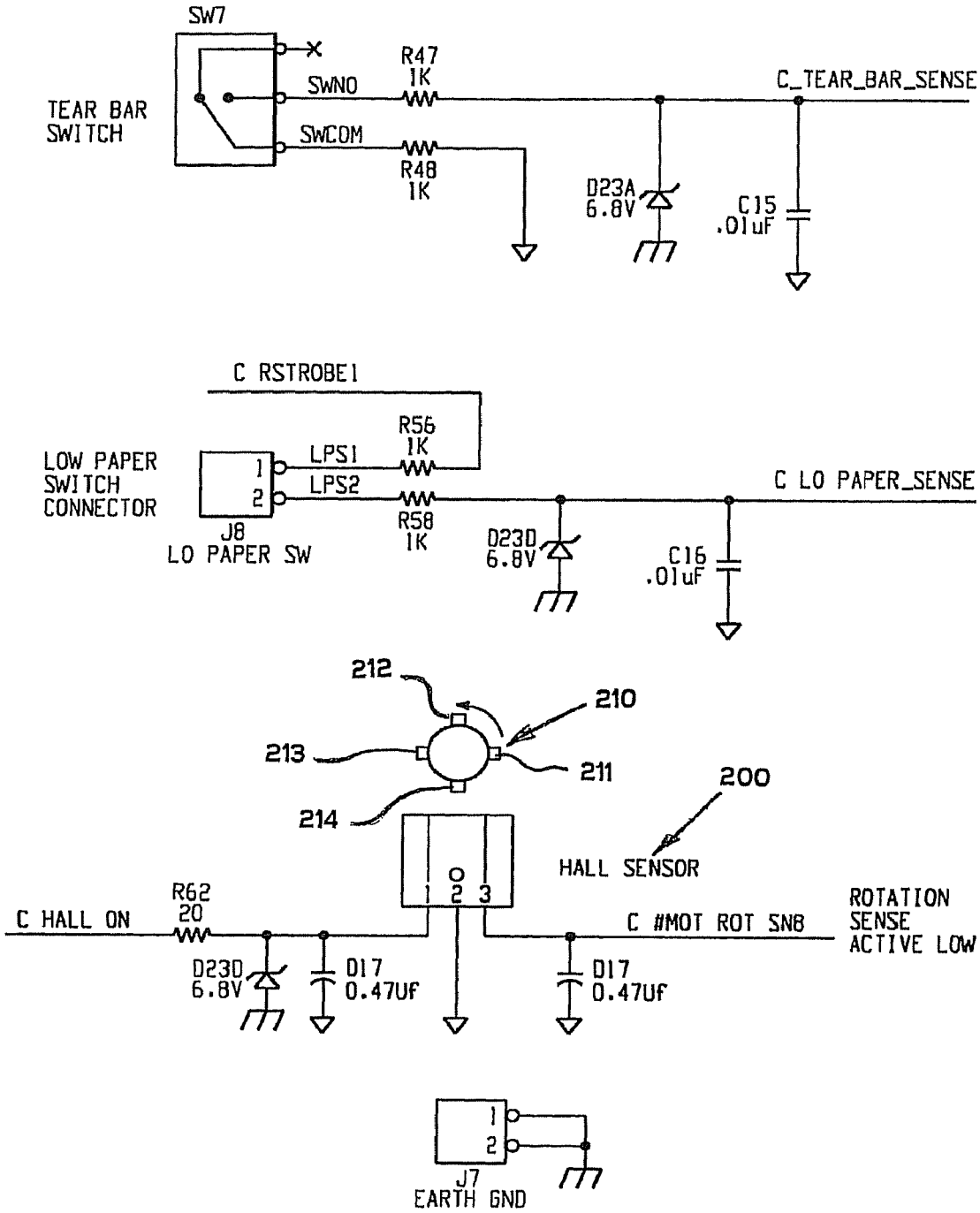
FIG. 16B is a schematic illustration of a second portion of the connector circuit board for the dispenser.
Figure 17:
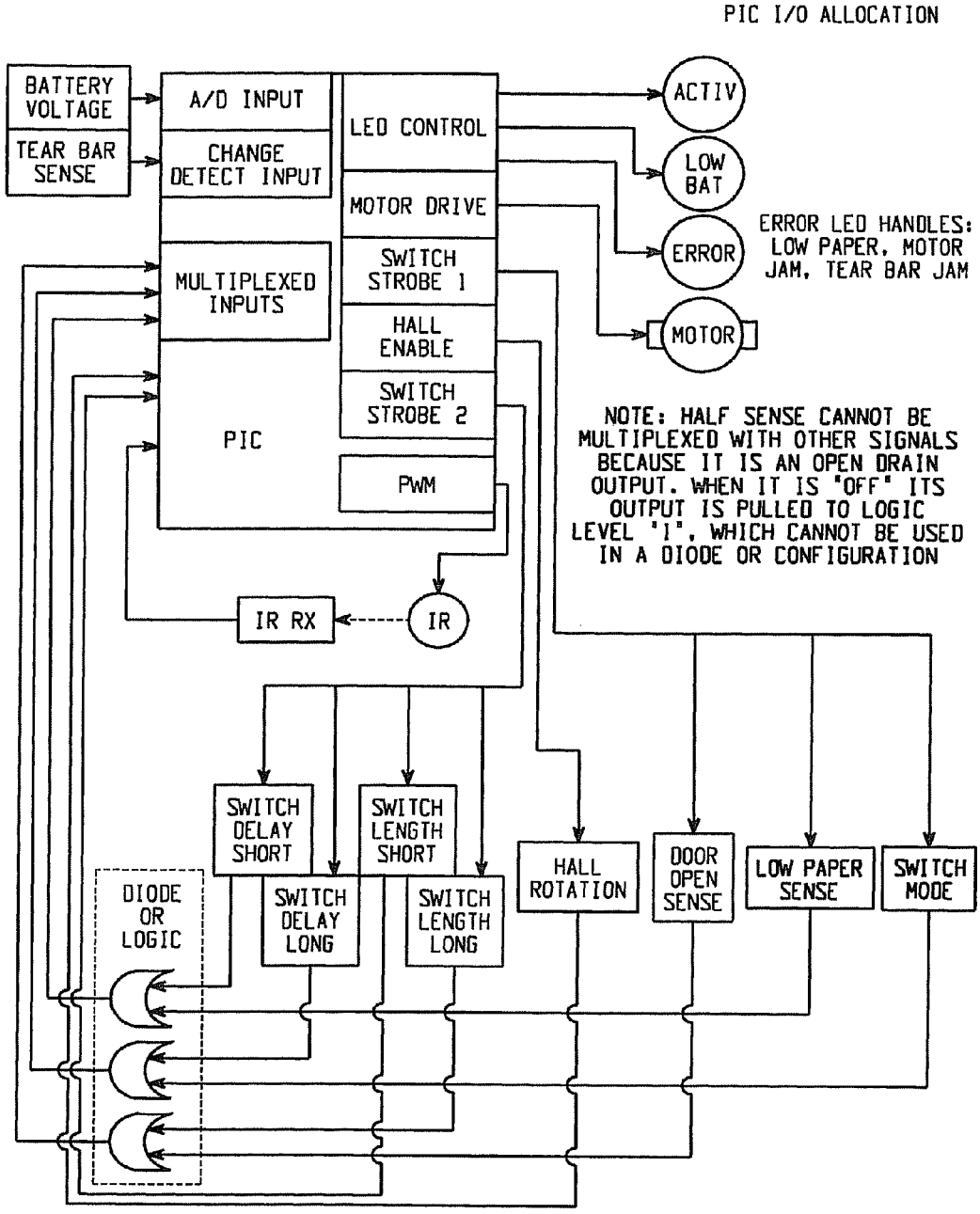
FIG. 17 is a block diagram illustrating programmable interrupt controller (PIC) input/out (I/O) allocation for a dispenser embodiment.
Figure 18:
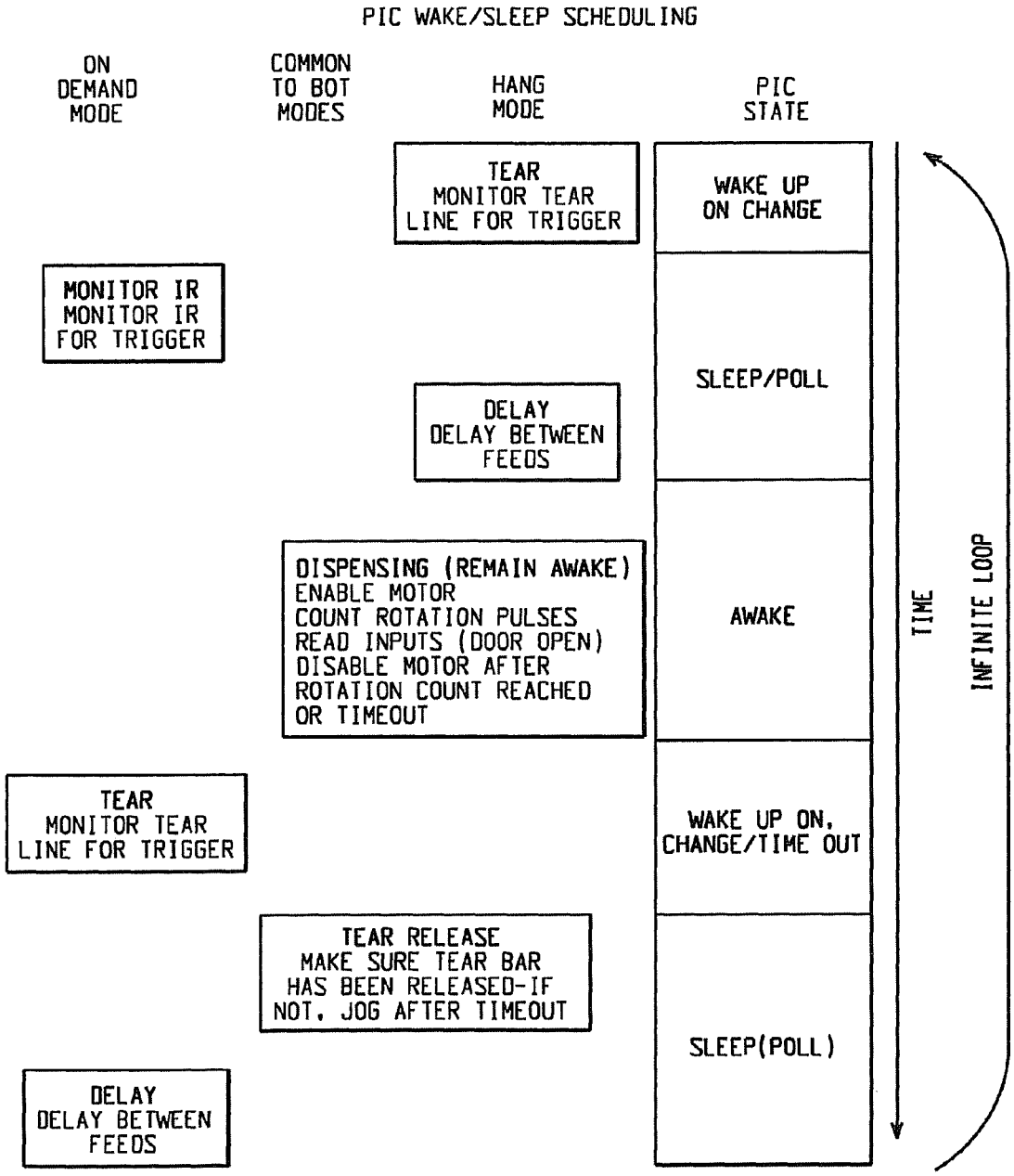
FIG. 18 is an embodiment of firmware for wake/sleep cycle for a dispenser embodiment.

In one embodiment, shaft rotation is monitored by a Hall sensor 200 (see FIG. 16B). A magnet 210 upon the paper roller has 4 poles (N-S-N-S) 211, 212, 213, 214 on it (see FIG. 16B). Thus, one rotation provides four pulses—hi-lo-hi-lo. The MCU counts every edge transition, giving four counts per shaft rotation. This is an improvement over earlier dispenser designs, which counted only the rising edges of the Hall output (i.e., 2 counts per revolution). This change advantageously cuts paper length error in half. The Hall sensor output is open drain, which means an external pull-up resistor is employed for proper operation. This means when powered off, the Hall output signal is pulled up to logic '1 '. This point makes it unsuitable for diode ORing with other active high signals as it would always report a logic '1', overriding the other signal multiplexed on the input pin. Thus, the Hall sensor output remains on its own dedicated input line.

Battery Voltage

In one embodiment, with 4 D cells installed, the maximum possible Voltage is 4×1.5V=6.0 Volts. The MCU can only sample a maximum input of 3.3 Volts (it's own supply Voltage). A resistor divider network is used to cut the battery Voltage in half at the microcontroller input pin. Thus, a full reading on fresh batteries reports 6 Volts/2=3 Volts at the microcontroller input pin.

The microcontroller has 10 bits of sampling resolution. To keep the coding simple the two bottom bits (4 counts) are ignored. This yields a resolution of (3.3 V range/1024 sample space)*4 counts=13 mVolts at the port pin, or 26 mV of the true battery Voltage. This is actually lower than the tolerances of the circuit components in the Voltage divider so no information has been lost by this approximation.

Low battery detection is set for 4 Volts (2 Volts at the MCU port pin after the Voltage divider.) It is updated every five seconds. It is not checked during a sheet dispense as such action draws a large amount of current which can cause Voltage sags.

Tear Bar and Paper Jams

In one embodiment, the tear bar is a serrated length of metal hinged along the paper chute. As the user lifts a sheet of paper, the teeth cut the hanging paper length from the roll. This action also levers the tear bar on a pivot, asserting the tear bar switch mechanism.

Occasionally, the paper's edge wedges the tear bar in the open position. This prevents it from returning to the non-asserted position. As the firmware uses the tear bar for triggering, it is important that the tear bar return to the non-asserted position. If the tear bar is found stuck open, the motor is advanced approximately one-fourth turn in an effort to free the paper edge. If the tear bar is still asserted, the firmware advances the motor a second time. If this still does not clear the tear bar, a paper jam is declared. The dispenser is held in a non-operative mode and the error/service LED is asserted.

Manual Paper Feed Push Button

The manual feed button allows loading/dispensing of paper to the dispenser. There are no lockouts on motor control via firmware as this push button is tied directly to the motor drive circuitry.

LEDs

In one embodiment, there are three LEDs located in the IR window 16 in the cover of the dispenser 14: Active LED, Low Battery LED, and Low Paper/Error LED. The activity LED lights whenever the dispenser is active. This includes detection of a hand (On Demand mode only), dispensing a sheet, and the inter sheet delay period. All other times, this LED is dark. The Low Battery LED blinks when the battery voltage is determined below desired level. The low Paper/Error LED blinks when the dispenser requires servicing. This includes a low paper condition, or a paper jam condition. Once set, this LED continues to blink unit the dispenser door is opened and the dispenser is serviced.

Firmware Considerations

System Service Cycle

To conserve battery life, battery voltage, low paper check, and switch settings are checked once every 5 seconds. Therefore, it takes that long to update corresponding LED indicators and switch settings. This means anyone servicing the dispenser will see a 5 second delay configuration settings have been changed. For example: if someone servicing the dispenser switches the mode switch from On Demand to Hang mode, the dispenser will take up to 5 seconds to noticed the new switch setting and reset itself for the new mode.

Changing Batteries/Power On

In one embodiment, there is no on/off switch in the dispenser design. As such, the dispenser powers up as soon as batteries are inserted. Electrically speaking, this is a harsh, noisy event from the point of view of the MCU. In general, if a microcontroller does not have a clean power-on transition, the dispenser may power up in a bad state (e.g., lock-up). To remedy this possibility, the dispenser design employs a hardware watchdog timer. This monitoring dispenser operates independently of the dispenser firmware code. If the dispenser experiences a harsh start-up and becomes "lost", the watchdog will eventually time out (approx 32 ms) and perform a system reset. Presumably, the power will have stabilized at this point and a normal power on reset will commence. If not, the watchdog will trigger again and the process will repeat until the power supply is stable and a clean power up has been executed.

After initial power-up is complete, the watchdog is reconfigured to its maximum timeout period (approximately two seconds). In this configuration, the firmware has 2 seconds to clear the watchdog timer—otherwise a system reset will occur. Since normal program loop time is 100 ms there is ample time for normally operating code to keep the watchdog at bay. This provides protection against run time errors.

Watchdog Placement

It is good coding practice to keep the number of watchdog timer reset locations to a minimum. Ideally one location is best. However, due to limitations (listed below), the dispenser firmware has three watchdog reset locations:

| | |
|---|---|
| Head of Main Loop: | Cleared each time the dispenser wakes up (every 100 ms). This is normal operation in idle/monitoring mode. |
| During Dispense: | Long sheet length/low battery power can rival the watchdog timeout rate, as such the watchdog is cleared during each sheet dispense. |
| During Open Door: | While the door to the dispenser is open, the main loop is not being executed, as such the watchdog timer is cleared while waiting for the door to close. |

In one embodiment, there is a structure to attenuate out of band signals, but in band signals can be generated and accepted from other sources than the dispenser. The presence or absence of the carrier frequency during the ON time of the sampling period is observed. There is no phase relationship requirement at the carrier frequency, nor is there any specific encoding modulation specific to the dispenser.

The overall pulse train is switched on and off approx 10 times per second, at a low duty cycle. The on board MCU accepts a signal during the on time, so this lowers the chances of intercepting a signal from another dispenser. The IR receiver IC from Vishay, uses a narrow band filter to accept only IR signals modulated at a certain rate. In an embodiment, a 455 kHz receiver is utilized. This will accept signals from any other IR source at close to the 455 kHz, as well as from the source generated by the dispenser.

In one embodiment, there is no timing circuit in the dispenser that controls the operation of the motor to control the length of the paper dispensed by the dispenser. The length of the paper is determined by counting pulses from a magnetic encoder wheel on a paper roller, not by timing the length of time that the dispense motor runs. Time between pulses is monitored. If pulse intervals are too great, an error LED flashes to indicate a paper jam. This timing circuit is not a "monostable circuit." A monostable circuit is typically a set-reset flip flop whose ON time is determined by a single charge of a capacitor through a resistor. Timing in the dispenser is determined by counting multiple clock cycles from a repetitively charging RC clock circuit, often referred to as an "astable circuit".

In one embodiment, power is supplied to the IR LED in the dispenser from either a battery pack or external AC-DC adaptor. The motor is driven from this raw DC input voltage. The DC input supplies a three terminal voltage regulator that powers the MCU. The MCU switches power on and off to the other circuit elements, the Hall rotation Sensor, Visible LED's, IR LED, and IR receiver.

In one embodiment, there is a structure in the dispenser that protects the rest of the dispenser components from noise/fluctuations generated in the IR LED part. For example, the IR LED circuit may contain a 0.47 micro Faraday (μf) capacitor to supply peak current demand when the LED switches ON.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A dispenser for dispensing sheet product, comprising:

a housing;

a proximity sensor operative to detect a presence of a user's hand at a predetermined location near the dispenser;

a tear bar operative to pivot in response to an existing sheet product being torn from the dispenser;

a tear bar switch in operable communication with the tear bar;

a dispensing mechanism disposed within the housing, the dispensing mechanism comprising an electronic controller operably coupled to a drive motor that is operably coupled to a feed roller to dispense the sheet product;

wherein the dispensing mechanism is operative in a first mode to be responsive to a signal from the proximity sensor to dispense the sheet product;

wherein the dispensing mechanism is operative in a second mode to dispense a next sheet product in response to the tear bar asserting the tear bar switch in response to the existing sheet product being torn from the dispenser;

wherein the infrared proximity sensor comprises an infrared emitter and an infrared detector, the infrared emitter is disposed and configured to emit an infrared light energy, the presence of a user's hand serves to reflect the emitted infrared light energy, and the adjustable sensitivity of the infrared proximity sensor is adjustable by changing an effective distance of the reflected infrared light energy; and wherein the infrared proximity sensor comprises a plurality of resistors electrically interconnected with the infrared emitter to allow for higher or lower currents through the infrared emitter, thereby affecting the intensity of infrared light emitted, and thereby changing the effective distance of the reflected infrared light energy.

2. The dispenser of claim 1, further comprising:

a three-pole slide switch operably connected to the infrared emitter to adjust the sensitivity of the infrared proximity sensor.

* * * * *